US009341198B2

(12) United States Patent
Nakamura et al.

(10) Patent No.: US 9,341,198 B2
(45) Date of Patent: May 17, 2016

(54) HYDRAULIC DRIVE DEVICE FOR WORKING MACHINE

(75) Inventors: Tsuyoshi Nakamura, Tsuchiura (JP); Kazunori Nakamura, Tsuchiura (JP); Yasuo Okano, Tsuchiura (JP); Kouji Ishikawa, Tsuchiura (JP); Kensuke Sato, Tsuchiura (JP); Hiroyuki Azuma, Tsuchiura (JP); Mitsuhiko Kanehama, Tsuchiura (JP); Yusuke Kajita, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 303 days.

(21) Appl. No.: 14/118,141

(22) PCT Filed: May 17, 2012

(86) PCT No.: PCT/JP2012/062660

§ 371 (c)(1),
(2), (4) Date: Nov. 15, 2013

(87) PCT Pub. No.: WO2012/157705

PCT Pub. Date: Nov. 22, 2012

(65) Prior Publication Data

US 2014/0090369 A1 Apr. 3, 2014

(30) Foreign Application Priority Data

May 19, 2011 (JP) ..... 2011-112626

(51) Int. Cl.
*F15B 15/20* (2006.01)
*E02F 9/22* (2006.01)
*E02F 9/12* (2006.01)

(52) U.S. Cl.
CPC ..... *F15B 15/20* (2013.01); *E02F 9/123* (2013.01); *E02F 9/2242* (2013.01); *E02F 9/2285* (2013.01); *E02F 9/2292* (2013.01); *E02F 9/2296* (2013.01)

(58) Field of Classification Search
CPC ..... F15B 11/024; E02F 9/2292
USPC ..... 60/486
See application file for complete search history.

(56) References Cited

U.S. PATENT DOCUMENTS 4,207,740 A 6/1980 Ripa
4,561,824 A * 12/1985 Okabe ..... E02F 9/2239 414/697

(Continued)

FOREIGN PATENT DOCUMENTS

GB 2 045 360 A 10/1980
JP 55-87821 U 6/1980

(Continued)

OTHER PUBLICATIONS

International Search Report dated Jun. 19, 2012 with English translation (four (4) pages).

(Continued)

*Primary Examiner* — Thomas E Lazo
(74) *Attorney, Agent, or Firm* — Crowell & Moring LLP

(57) ABSTRACT

A hydraulic drive device for a hydraulic excavator, includes: a first hydraulic pump; a first boom directional control valve and a second arm directional control valve which are connected in parallel to the first pump; a second hydraulic pump; and a second boom directional control valve and a first arm directional control valve which are connected in parallel to the second pump; wherein: the hydraulic drive device also includes: a third hydraulic pump; a third boom directional control valve connected to the third pump and controlling the flow of pressure oil supplied to a boom cylinder; and a third arm directional control valve connected in tandem with the third boom directional control valve and controlling the flow of pressure oil supplied to an arm cylinder.

22 Claims, 3 Drawing Sheets

(56) References Cited

U.S. PATENT DOCUMENTS

| | | | | | |
|---|---|---|---|---|---|
| 5,442,912 | A * | 8/1995 | Hirata | E02F 9/2221 | 60/426 |
| 5,673,558 | A * | 10/1997 | Sugiyama | E02F 9/2228 | 60/426 |
| 5,940,997 | A * | 8/1999 | Toyooka | E02F 9/2221 | 37/411 |
| 7,487,609 | B2 * | 2/2009 | Nakamura | E02F 9/2075 | 37/348 |
| 7,607,245 | B2 * | 10/2009 | Satake | E02F 9/2075 | 37/348 |
| 8,336,443 | B2 * | 12/2012 | Abe | E02F 9/2203 | 91/436 |
| 8,424,299 | B2 * | 4/2013 | Kakizawa | E02F 3/308 | 60/368 |
| 2008/0110166 | A1 | 5/2008 | Stephenson et al. | | |
| 2010/0162696 | A1 | 7/2010 | Kakizawa et al. | | |

FOREIGN PATENT DOCUMENTS

| | | | | |
|---|---|---|---|---|
| JP | 55-87821 | A | | 7/1980 |
| JP | 60-203744 | A | | 10/1985 |
| JP | 8-13547 | A | | 1/1996 |
| JP | 8-218443 | A | | 8/1996 |
| JP | 8-219107 | A | | 8/1996 |
| JP | 08218443 | A | * | 8/1996 |
| JP | 11-82416 | A | | 3/1999 |
| JP | 2003-113809 | A | | 4/2003 |
| JP | 2003-184815 | A | | 7/2003 |
| JP | 2005-232961 | A | | 9/2005 |

OTHER PUBLICATIONS

European Search Report dated Feb. 2, 2015 (Nine (9) pages).

* cited by examiner

HYDRAULIC DRIVE DEVICE FOR WORKING MACHINE

TECHNICAL FIELD

The present invention relates to a hydraulic drive device for a working machine which is provided with a working device including a boom and an arm connected to the boom and which can perform combined operation of boom raising and arm crowding.

BACKGROUND ART

As this type technique according to the background art, there is a technique disclosed in Patent Literature 1. In this Patent Literature 1, disclosed is a working machine such as a hydraulic excavator provided with a body including an upperstructure, and a working device attached to the upperstructure, the working device including a boom which is connected to the upperstructure so as to be rotatable in an up/down direction, an arm which is connected to a distal end of the boom so as to be rotatable in the up/down direction, a boom cylinder which drives the boom, and an arm cylinder which drives the arm. In this Patent Literature 1, disclosed is a configuration in which a hydraulic circuit device provided in the hydraulic excavator, that is, a hydraulic drive device includes a first hydraulic pump and a second hydraulic pump which supply pressure oil for operating the boom cylinder and the arm cylinder respectively, a first boom directional control valve connected to the first hydraulic pump and in parallel with a second arm directional control valve so as to control a flow of the pressure oil supplied to the boom cylinder, the second arm directional control valve connected to the first hydraulic pump and in parallel with the first boom directional control valve so as to control a flow of the pressure oil supplied to the arm cylinder, a second boom directional control valve connected to the second hydraulic pump and in parallel with a first arm directional control valve so as to control a flow of the pressure oil supplied to the boom cylinder, and the first arm directional control valve connected to the second hydraulic pump and in parallel with the second boom directional control valve so as to control a flow of the pressure oil supplied to the arm cylinder.

Though not shown in the aforementioned Patent Literature 1, as a hydraulic drive device provided in a working machine such as a hydraulic excavator, it has been hitherto known that a fixed throttle is provided on the upstream side of an arm directional control valve which will serve as the low pressure side during combined operation of boom raising and arm crowding, in consideration of controllability during the combined operation. As this type technology according to the background art, there is a technique disclosed in Patent Literature 2.

In addition, though not shown in the aforementioned Patent Literature 1, as a hydraulic drive device provided in a working machine such as a hydraulic excavator, there has been hitherto known a hydraulic drive device provided with a regenerative circuit having a throttle which narrows a return pipe line so that oil discharged from a rod chamber of an arm cylinder can be regeneratively supplied to a bottom chamber during arm crowding operation for moving down an arm by its own weight. As this type technology according to the background art, for example, there is a technique disclosed in Patent Literature 3.

CITATION LIST

Patent Literature

Patent Literature 1: JP-A-11-82416
Patent Literature 2: JP-A-8-13547
Patent Literature 3: JP-A-8-219107

SUMMARY OF INVENTION

Technical Problem

In a hydraulic drive device in which a hitherto known technique as disclosed in Patent Literature 2 is taken into consideration in the background-art technique disclosed in the aforementioned Patent Literature 1, that is, in a background-art hydraulic drive device in which a pipe line on the upstream side of an arm directional control valve serving as the low pressure side is narrowed in order to ensure controllability in combined operation of boom raising and arm crowding, the loss of pressure caused by the narrowing of the pipe line is large so that a large load is applied to a hydraulic pump. Thus, the pump efficiency is apt to be lowered. For that reason, engine output must be increased in order to increase the operation speed or the like to thereby improve the productivity. As a result, the fuel cost increases. That is, in the background art, it is difficult to obtain a greater energy saving effect while improving the productivity.

In addition, in a hydraulic drive device in which a hitherto known technique as disclosed in Patent Literature 3 is taken into consideration in the background-art technique disclosed in the aforementioned Patent Literature 1, that is, in a background-art hydraulic drive device in which a return pipe line is narrowed to carry out regeneration during arm crowding, the loss of pressure caused by the narrowing of the pipe line is likewise large so that a large load is applied to a hydraulic pump. Thus, the pump efficiency is apt to be lowered. For that reason, engine output must be increased in order to increase the operation speed or the like to thereby improve the productivity. As a result, the fuel cost increases. That is, in the background art, it is difficult to obtain a great energy saving effect while improving the productivity.

The present invention was developed in consideration of the aforementioned actual situation in the background art. An object of the invention is to provide a hydraulic drive device for a working machine, capable of performing combined operation of boom raising and arm crowding without providing a throttle, and capable of performing arm crowding operation in the same manner as in the case where a regenerative circuit having a throttle is provided.

Solution to Problem

In order to achieve the object, according to the invention, there is provided a hydraulic drive device for a working machine, the hydraulic drive device being provided in the working machine including a body and a working device attached to the body, the working device including a boom connected to the body so as to be rotatable in an up/down direction, an arm connected to a distal end of the boom so as to be rotatable in the up/down direction, a boom cylinder driving the boom, and an arm cylinder driving the arm, the hydraulic drive device including: a first hydraulic pump and a second hydraulic pump which supply pressure oil for operating the boom cylinder and the arm cylinder respectively; a first boom directional control valve and a second arm directional control valve connected in parallel to the first hydraulic pump so that the first boom directional control valve controls a flow of the pressure oil supplied to the boom cylinder and the second arm directional control valve controls a flow of the pressure oil supplied to the arm cylinder; and a second boom directional control valve and a first arm directional control valve connected in parallel to the second hydraulic pump so that the second boom directional control valve controls a flow of the pressure oil supplied to the boom cylinder and the first arm directional control valve controls a flow of the pressure oil supplied to the arm cylinder; wherein: the hydraulic drive device further includes: a third hydraulic pump which supplies pressure oil for operating the boom cylinder and the arm cylinder; a third boom directional control valve connected to the third hydraulic pump so as to control a flow of the pressure oil supplied to the boom cylinder; and a third arm directional control valve connected in tandem with the third boom directional control valve so as to control a flow of the pressure oil supplied to the arm cylinder.

According to the invention configured thus, during the combined operation of boom raising and arm crowding, the pressure oil of the third hydraulic pump is supplied to the boom cylinder by priority through the third boom directional control valve connected in tandem with the third arm directional control valve on the upstream side, so that the boom cylinder can be operated to perform boom raising, while the pressure oil of the first hydraulic pump is supplied to the arm cylinder through the second arm directional control valve and the pressure oil of the second hydraulic pump is supplied to the arm cylinder through the first arm directional control valve, that is, a sufficient flow rate of pressure oil is supplied to the arm cylinder so that the arm cylinder can be operated to perform arm crowding. In addition, the pressure oil can be supplied to the boom directional control valve without narrowing the pressure oil supplied to the arm directional control valves during the boom raising operation and the arm crowding operation. Thus, the combined operation of boom raising and arm crowding can be performed without providing a throttle on the upstream side of the arm directional control valves and the arm crowding operation can be performed without providing a regenerative circuit having a throttle. It is therefore possible to reduce a loss of pressure in the combined operation of boom raising and arm crowding and a loss of pressure in the arm crowding operation, so that it is possible to improve the pump efficiency.

In addition, according to the invention, there is provided a hydraulic drive device for a working machine in the aforementioned configuration of the invention, wherein: the body includes an upperstructure; and the hydraulic drive device further includes a swing motor which drives the upperstructure, and a swing directional control valve which is connected to the third hydraulic pump so as to control a flow of the pressure oil supplied to the swing motor.

According to the invention configured thus, during the combined operation of the swing, the boom and the arm, the pressure oil of the third hydraulic pump is supplied to the swing motor through the swing directional control valve and to the boom cylinder through the third boom directional control valve, the pressure oil of the first hydraulic pump is supplied to the boom cylinder through the first boom directional control valve or to the arm cylinder through the second arm directional control valve, and further the pressure oil of the second hydraulic pump is supplied to the boom cylinder through the second boom directional control valve or to the arm cylinder through the first arm directional control valve, so that good combined controllability among the upperstructure, the boom and the arm can be secured.

In addition, according to the invention, there is provided a hydraulic drive device for a working machine in the aforementioned configuration of the invention, wherein: the third boom directional control valve has a boom raising selection position which is a selection position for rotating the boom upward and a boom lowering selection position which is a selection position for rotating the boom downward, and a block port which blocks the supply of the pressure oil discharged from the third hydraulic pump to the boom cylinder is provided in the boom lowering selection position.

According to the invention configured thus, during the combined operation of boom lowering and swing, the pressure oil introduced from the third hydraulic pump to the third boom directional control valve is blocked by the block port in the boom lowering selection position of the third boom directional control valve, so that the pressure oil of the third hydraulic pump can be supplied only to the swing motor through the swing directional control valve. That is, swinging can be performed independently without being affected by the boom lowering operation, so that excellent acceleration of swinging can be secured.

In addition, according to the invention, there is provided a hydraulic drive device for a working machine in the aforementioned configuration of the invention, wherein: the swing directional control valve and the third boom directional control valve are connected in parallel.

According to the invention configured thus, during the combined operation of boom raising and swing, the pressure oil of the third hydraulic pump can be supplied to both the boom cylinder and the swing motor through the third boom directional control valve and the swing directional control valve. In this manner, it is possible to perform boom raising while suppressing the swing speed so that it is possible to secure suitable controllability in the combined operation of boom raising and swing to actual work.

In addition, according to the invention, there is provided a hydraulic drive device for a working machine in the aforementioned configuration of the invention, wherein: the working device includes a bucket connected to a distal end of the arm so as to be rotatable in the up/down direction, and a bucket cylinder operating the bucket; the hydraulic drive device further includes a bucket directional control valve which controls a flow of the pressure oil supplied to the bucket cylinder; and the first boom directional control valve, the second arm directional control valve and the bucket directional control valve are connected in parallel.

According to the invention configured thus, during the combined operation of boom raising, arm crowding and bucket crowding, the pressure oil of the third hydraulic pump is supplied to the boom cylinder through the third boom directional control valve, the pressure oil of the second hydraulic pump is supplied to the arm cylinder through the first arm directional control valve, and the pressure oil of the first hydraulic pump is supplied to the bucket cylinder through the bucket directional control valve, so that the combined operation of boom raising, arm crowding and bucket crowding can be performed. That is, the combined operation of boom raising, arm crowding and bucket crowding can be performed without the aid of a throttle, so that the loss of pressure during the combined operation can be reduced.

In addition, according to the invention, there is provided a hydraulic drive device for a working machine in the aforementioned configuration of the invention, further including: a first auxiliary directional control valve which is connected to the second hydraulic pump; and an auxiliary flow combiner valve by which the pressure oil discharged from the first hydraulic pump can be supplied to the first auxiliary directional control valve.

According to the invention configured thus, for example, a first special attachment is connected to the arm and a first actuator driving the first special attachment is provided so that the first actuator can be controlled by the first auxiliary directional control valve. In this case, the pressure oil of the second hydraulic pump is supplied to the first actuator through the first auxiliary directional control valve so that the first special attachment can be driven. In addition, when the first special attachment is driven at a high operating speed, the auxiliary flow combiner valve is selected so that the pressure oil of the first hydraulic pump can be supplied to the first actuator through the auxiliary flow combiner valve and the first auxiliary directional control valve. That is, the pressure oil of the first hydraulic pump and the pressure oil of the second hydraulic pump can be combined and supplied to the first actuator through the first auxiliary directional control valve so as to drive the first special attachment at a high operating speed.

In addition, during the combined operation where the aforementioned first special attachment is combined with the boom and the arm, for example, the pressure oil of the second hydraulic pump is supplied to the first auxiliary directional control valve or the pressure oil of the first hydraulic pump and the pressure oil of the second hydraulic pump are combined to operate the first actuator to drive the first special attachment, while the pressure oil of the third hydraulic pump is supplied to the boom cylinder or the arm cylinder through the third boom directional control valve or the third arm directional control valve so that the boom or the arm can be driven. That is, the combined operation where the first special attachment is thus combined with the boom and the arm can be carried out without the aid of a throttle. Thus, there is no fear that the loss of pressure caused by the throttle may be generated.

In addition, according to the invention, there is provided a hydraulic drive device for a working machine in the aforementioned configuration of the invention, further including: a second auxiliary directional control valve which is connected to the third hydraulic pump.

According to the invention configured thus, for example, a second special attachment is connected to the arm, and a second actuator driving the second special attachment is provided so that the second actuator can be controlled by the second auxiliary directional control valve. In this case, the pressure oil of the third hydraulic pump can be supplied to the second actuator through the second auxiliary directional control valve to drive the second special attachment. Incidentally, the second auxiliary directional control valve can be easily exchanged for a second bucket directional control valve for accelerating the bucket if occasion demands. In this manner, when the second bucket directional control valve is provided in place of the second auxiliary directional control valve, the pressure oil of the third hydraulic pump can be combined with the pressure oil of the first hydraulic pump through the second bucket directional control valve and supplied to the bucket cylinder, so that the operating speed of the bucket can be accelerated.

In addition, according to the invention, there is provided a hydraulic drive device for a working machine in the aforementioned configuration of the invention, wherein: the swing directional control valve, the third boom directional control valve and the second auxiliary directional control valve are connected in parallel.

According to the invention configured thus, the pressure oil of the third hydraulic pump is supplied to the swing motor through the swing directional control valve and concurrently supplied to the second actuator through the second auxiliary directional control valve, so that the combined operation where swinging is combined with the second special attachment can be carried out.

In addition, according to the invention, there is provided a hydraulic drive device for a working machine in the aforementioned configuration of the invention, wherein: the second auxiliary directional control valve has an additional pump port to which an additional hydraulic pump can be connected.

According to the invention configured thus, an additional hydraulic pump may be connected to the additional pump port of the second auxiliary directional control valve through a pipe arrangement so that the pressure oil of the additional hydraulic pump can be supplied to the second special attachment through the second auxiliary directional control valve and the second actuator. That is, the second special attachment can be driven independently of the operation of the swing, the boom and the arm.

In addition, according to the invention, there is provided a hydraulic drive device for a working machine in the aforementioned configuration of the invention, wherein: the second boom directional control valve, the first arm directional control valve and the first auxiliary directional control valve are connected in parallel.

According to the invention configured thus, the pressure oil of the second hydraulic pump is supplied to the first auxiliary directional control valve or the pressure oil of the first hydraulic pump and the pressure oil of the second hydraulic pump are combined and supplied to the first auxiliary directional control valve, so that, for example, the first actuator controlled by the first auxiliary directional control valve can be operated to drive the first special attachment. At the same time, the placement of the swing directional control valve and the placement of the first auxiliary directional control valve can be exchanged for each other easily if occasion demands. When the swing directional control valve and the first auxiliary directional control valve can be exchanged for each other in this manner, the first auxiliary directional control valve and the second auxiliary directional control valve are connected to the third hydraulic pump so that the pressure oil of the second hydraulic pump can be supplied to the swing motor through the swing directional control valve to thereby swing the upperstructure, while drive circuits for the first and second special attachments controlled by the first and second auxiliary directional control valves can be made independent and driven by the pressure oil of the third hydraulic pump.

In addition, according to the invention, there is provided a hydraulic drive device for a working machine in the aforementioned configuration of the invention, further including: a regenerative circuit which is provided in the boom lowering selection position of the third boom directional control valve so that the oil discharged from a bottom chamber of the boom cylinder can be regeneratively supplied to a rod chamber of the boom cylinder during the boom lowering operation; and a boom directional control valve control unit which holds the third boom directional control valve in the boom lowering selection position and holds the first boom directional control valve and the second boom directional control valve in neutral positions when bottom pressure of the boom cylinder is not lower than a predetermined pressure during the boom lowering operation, and which holds the third boom directional control valve in the boom lowering selection position, holds the first boom directional control valve in the boom lowering selection position where the pressure oil discharged from the first hydraulic pump can be supplied to the rod chamber of the boom cylinder, and holds the second boom directional control valve in the boom lowering selection position where the pressure oil discharged from the second hydraulic pump can be supplied to the rod chamber of the boom cylinder when the bottom pressure of the boom cylinder is lower than the predetermined pressure during the boom lowering operation.

According to the invention configured thus, when the operation of boom lowering is carried out in the air, the boom moves down due to its own weight. In the meantime, the bottom pressure of the boom cylinder reaches the predetermined pressure or higher. On this occasion, by the boom directional control valve control unit, the third boom directional control valve is held in the boom lowering selection position, and the first boom directional control valve and the second boom directional control valve are held in the neutral positions. As a result, the oil discharged from the bottom chamber of the boom cylinder is regeneratively supplied to the rod chamber of the boom cylinder through the regenerative circuit provided in the boom lowering selection position of the third boom directional control valve. Thus, the boom cylinder can retract to carry out the operation of boom lowering. That is, the pressure oil of the first hydraulic pump, the pressure oil of the second hydraulic pump and the pressure oil of the third hydraulic pump are not supplied to the boom cylinder, but the flow rates discharged from the first hydraulic pump, the second hydraulic pump and the third hydraulic pump can be minimized. In this manner, the energy consumption can be limited to the minimum.

In addition, when boom lowering is carried out in the state where the boom is on the ground or the like, that is, when jack-up operation is performed, the bottom pressure of the boom cylinder becomes a low pressure which does not reach the aforementioned predetermined pressure. On this occasion, due to the control of the boom directional control valve control unit, the third boom directional control valve is changed over to the boom lowering selection position and the first boom directional control valve and the second boom directional control valve are changed over to the boom lowering selection positions respectively. Thus, the pressure oil of the first hydraulic pump is supplied to the boom cylinder through the first boom directional control valve and the pressure oil of the second hydraulic pump is supplied to the boom cylinder through the second boom directional control valve, so that desired jack-up operation can be performed.

In addition, according to the invention, there is provided a hydraulic drive device for a working machine in the aforementioned configuration of the invention, further including: an open valve which is provided in a return pipe line connecting a tank and at least one of the first arm directional control valve, the second arm directional control valve and the third arm directional control valve, so that the open valve keeps a small opening amount when the arm is not operated, and increases the opening amount with the increase of an operation amount of the arm during the arm crowding operation.

According to the invention configured thus, when the operation of arm crowding is performed, the open valve has a small opening amount at the beginning of the operation. Accordingly, the amount of oil returned from the rod chamber of the arm cylinder to the tank through the corresponding arm directional control valve and the open valve is small enough to decelerate the operating speed of arm crowding. Thus, the arm begins to move down slowly due to the pressure oil supplied to the bottom chamber of the arm cylinder from the corresponding one of the first, second and third hydraulic pumps. As a result, impact at the beginning of the operation of arm crowding can be prevented from occurring. In addition, when the operation amount increases, the opening amount of the open valve increases to increase the amount of oil returned from the rod chamber of the arm cylinder to the tank through the corresponding arm directional control valve and the open valve. Thus, the operating speed of arm crowding is accelerated so that the arm moves down quickly. As a result, good controllability in the operation of arm crowding can be secured. Incidentally, when the opening amount of the open valve increases after the beginning of the operation of arm crowding, the arm cylinder can be operated with a small thrust force because the rod pressure of the arm cylinder decreases to be about as low as the tank pressure. That is, the load pressure for the operation of arm crowding can be reduced so that the pump efficiency of the corresponding hydraulic pump can be improved.

In addition, according to the invention, there is provided a hydraulic drive device for a working machine in the aforementioned configuration of the invention, further including: a first variable throttle which is provided on an upstream side of the second arm directional control valve.

According to the invention configured thus, the supply of the pressure oil of the first hydraulic pump to the second arm directional control valve forming the low pressure side can be limited by the first variable throttle during the combined operation of arm crowding and bucket crowding, so that the pressure oil of the first hydraulic pump can be supplied to the bucket cylinder by priority through the bucket directional control valve so as to operate the bucket cylinder. The arm cylinder is supplied with the pressure oil of the second hydraulic pump through the first arm directional control valve and with the pressure oil of the third hydraulic pump through the third arm directional control valve so that the arm cylinder can be operated. That is, it is possible to increase the operating speed of the bucket while securing the speed of the arm.

In addition, according to the invention, there is provided a hydraulic drive device for a working machine in the aforementioned configuration of the invention, further including: a second variable throttle which is provided on an upstream side of the first arm directional control valve.

According to the invention configured thus, for example, a first special attachment is connected to the arm and a first actuator for driving the first special attachment is provided and controlled by the first auxiliary directional control valve. In this case, the pressure oil of the second hydraulic pump can be supplied to the first actuator through the first auxiliary directional control valve to operate the first actuator while the flow of the pressure oil of the second hydraulic pump to the first arm directional control valve forming the low pressure side is suppressed by the second variable throttle during the four-combined operation of boom raising, arm crowding, bucket crowding and the first special attachment. That is, the pressure oil of the first hydraulic pump is supplied to the bucket cylinder by priority through the bucket directional control valve and the pressure oil of the second hydraulic pump is supplied to the arm cylinder through the second variable throttle and the first arm directional control valve while the pressure oil of the second hydraulic pump is also supplied to the first actuator through the first auxiliary directional control valve, and the pressure oil of the third hydraulic pump is supplied to the boom cylinder through the third boom directional control valve. Thus, the four-combined operation of boom raising, arm crowding, bucket crowding and the first special attachment can be carried out.

In addition, according to the invention, there is provided a hydraulic drive device for a working machine in the aforementioned configuration of the invention, further including: a discharge pressure detection unit which detects at least discharge pressure of the second hydraulic pump, of discharge pressure of the first hydraulic pump, the discharge pressure of the second hydraulic pump and discharge pressure of the third hydraulic pump; a directional control valve neutral holding unit which holds the third boom directional control valve and the third arm directional control valve in neutral positions when the discharge pressure detected by the discharge pressure detection unit is not lower than a predetermined pressure; and a pump control cancel unit which cancels pump swash angle control on the third hydraulic pump when the discharge pressure is not lower than the predetermined pressure.

According to the invention configured thus, the discharge pressure of the hydraulic pump detected by the discharge pressure detection unit reaches the predetermined pressure or higher when the work of heavy duty digging requiring a large digging force is performed, for example, by the combined operation of arm crowding and bucket crowding. On this occasion, the third boom directional control valve and the third arm directional control valve are held in the neutral positions by the directional control valve neutral holding unit, while pump swash angle control on the third hydraulic pump is canceled by the pump control cancel unit. Accordingly, the pressure oil of the first hydraulic pump is supplied to the bucket cylinder by priority through the bucket directional control valve, and the pressure oil of the second hydraulic pump is supplied to the arm cylinder through the first arm directional control valve. Thus, the combined operation of arm crowding and bucket crowding during the work of heavy duty digging can be performed by the control on the first hydraulic pump and the pump swash angle control on the second hydraulic pump without causing deterioration in the pump efficiency while good controllability is secured.

In addition, according to the invention, there is provided a hydraulic drive device for a working machine in the aforementioned configuration of the invention, wherein: the hydraulic drive device further includes an engine; of the first hydraulic pump, the second hydraulic pump and the third hydraulic pump, at least the third hydraulic pump consists of a variable displacement hydraulic pump which is driven by the engine; and the hydraulic drive device further includes a third hydraulic pump swash angle control unit which is provided to keep pump swash angle control on the third hydraulic pump not executed when operation of the arm is an arm crowding operation.

According to the invention configured thus, pump swash angle control on the third hydraulic pump is not performed by the third hydraulic pump swash angle control unit during the operation of arm crowding. Accordingly, the pressure oil of the first hydraulic pump is supplied to the arm cylinder through the second arm directional control valve, and the pressure oil of the second hydraulic pump is supplied to the arm cylinder through the first arm directional control valve, so that the arm cylinder can be operated by those pressure oils so as to perform arm crowding. That is, the operation of arm crowding can be performed without causing deterioration in the pump efficiency while good controllability is secured.

In addition, according to the invention, there is provided a hydraulic drive device for a working machine in the aforementioned configuration of the invention, wherein: the hydraulic drive device further includes an engine; of the first hydraulic pump, the second hydraulic pump and the third hydraulic pump, at least the first hydraulic pump consists of a variable displacement hydraulic pump which is driven by the engine; and the hydraulic drive device further includes a first hydraulic pump swash angle control unit which is provided to make control to increase a swash angle of the first hydraulic pump when bottom pressure of the boom cylinder is lower than a predetermined pressure during the boom lowering operation.

According to the invention configured thus, when the bottom pressure of the boom cylinder does not reach the predetermined pressure during the operation of boom raising, that is, when jack-up operation is performed, control to increase the swash angle of the first hydraulic pump, that is, to increase a flow rate from the first hydraulic pump is made by the first hydraulic pump swash angle control unit so that the increased flow rate is supplied to the boom cylinder through the first boom directional control valve. Thus, the jack-up operation can be performed while the influence on the pump efficiency is kept minimal.

In addition, according to the invention, there is provided a hydraulic drive device for a working machine in the aforementioned configuration of the invention, further including: a first flow rate limit control unit which limits a flow rate discharged from the first hydraulic pump to a predetermined rate lower than a maximum flow rate which can be discharged by the first hydraulic pump; a second flow rate limit control unit which limits a flow rate discharged from the second hydraulic pump to a predetermined rate lower than a maximum flow rate which can be discharged by the second hydraulic pump; and a third flow rate limit control unit which limits a flow rate discharged from the third hydraulic pump to a predetermined rate lower than a maximum flow rate which can be discharged by the third hydraulic pump.

According to the invention configured thus, the first flow rate limit control unit, the second flow rate limit control unit and the third flow rate limit control unit are operated selectively to limit the flow rates of pressure oils discharged from corresponding ones of the first hydraulic pump, the second hydraulic pump and the third hydraulic pump. Thus, a desired combined operation such as the combined operation of the arm and the special attachment or the combined operation of the bucket and the special attachment can be performed with minimum necessary flow rates, so that the pump efficiency can be improved.

In addition, according to the invention, there provided a hydraulic drive device for a working machine in the aforementioned configuration of the invention, further including: a first torque control unit which can variably control pump torque of the first hydraulic pump; a second torque control unit which can variably control pump torque of the second hydraulic pump; and a third torque control unit which can variably control pump torque of the third hydraulic pump.

According to the invention configured thus, the first torque control unit, the second torque control unit and the third torque control unit are operated selectively to control pump torques of corresponding ones of the first hydraulic pump, the second hydraulic pump and the third hydraulic pump. Thus, the total value of the pump torques is kept not to exceed the output torque of the engine, while the distribution of the flow rates of the pressure oils discharged from the corresponding ones of the first hydraulic pump, the second hydraulic pump and the third hydraulic pump is kept suitable, so that the pump efficiency can be improved while good controllability in the combined operation is secured.

In addition, according to the invention, there is provided a hydraulic drive device for a working machine in the aforementioned configuration of the invention, further including: a first torque control unit which can variably control pump torque of the first hydraulic pump and pump torque of the second hydraulic pump concurrently; and a second torque control unit which can variably control pump torque of the third hydraulic pump.

According to the invention configured thus, the first torque control unit and the second torque control unit are operated selectively to control pump torques of corresponding ones of the first hydraulic pump, the second hydraulic pump and the third hydraulic pump. Thus, due to the two torque control units for the pump torques of the three hydraulic pumps, the total value of the pump torques is kept not to exceed the output torque of the engine, while the distribution of the flow rates of the pressure oils discharged from the corresponding ones of the first hydraulic pump, the second hydraulic pump and the third hydraulic pump is kept suitable, so that the pump efficiency can be improved while good controllability in combined operation is secured. In addition, the control targets are the two torque control units so that it is easy to construct a control circuit.

In addition, according to the invention, there is provided a hydraulic drive device for a working machine in the aforementioned configuration of the invention, wherein: the hydraulic drive device further includes an engine; the working device further includes a bucket connected to a distal end of the arm so as to be rotatable in the up/down direction, and a bucket cylinder operating the bucket; the hydraulic drive device further includes a bucket directional control valve which controls a flow of the pressure oil supplied to the bucket cylinder; the first hydraulic pump, the second hydraulic pump and the third hydraulic pump consist of variable displacement hydraulic pumps which are driven by the engine, respectively; the hydraulic drive device further includes a first torque control unit which can variably control pump torque of the first hydraulic pump, a second torque control unit which can variably control pump torque of the second hydraulic pump, and a third torque control unit which can variably control pump torque of the third hydraulic pump; and the first torque control unit makes control to increase the pump torque of the first hydraulic pump during combined operation of the upperstructure and the bucket.

According to the invention configured thus, for example, the upperstructure and the bucket are swung from a dumping site to a digging site in order to dig soil etc. and dump the dug soil through the combined operation of the upperstructure and the bucket. In this case, the pump torque of the first hydraulic pump is increased by the first torque control unit so as to increase the flow rate of the pressure oil supplied from the first hydraulic pump to the bucket cylinder. Thus, the operating speed of the bucket cylinder can be increased. That is, the operation of bucket crowding is performed at a high operating speed till the upperstructure and the bucket return to the digging site. Thus, the bucket can be resumed to a working posture preferable for digging with a predetermined biting angle of its blade edge with respect to the ground. In this manner, it is possible to improve the working efficiency in the digging work.

In addition, according to the invention, there is provided a hydraulic drive device for a working machine in the aforementioned configuration of the invention, wherein: the hydraulic drive device further includes an engine; the working device further includes a bucket connected to a distal end of the arm so as to be rotatable in the up/down direction, and a bucket cylinder operating the bucket; the hydraulic drive device further includes a bucket directional control valve which controls a flow of the pressure oil supplied to the bucket cylinder; the first hydraulic pump, the second hydraulic pump and the third hydraulic pump consist of variable displacement hydraulic pumps which are driven by the engine, respectively; the hydraulic drive device further includes a first torque control unit which can variably control pump torque of the first hydraulic pump and pump torque of the second hydraulic pump concurrently, and a second torque control unit which can variably control pump torque of the third hydraulic pump; and the first torque control unit makes control to increase the pump torque of the first hydraulic pump and the pump torque of the second hydraulic pump during combined operation of the upperstructure and the bucket.

Also according to the invention configured thus, for example, the upperstructure and the bucket are swung from a dumping site to a digging site in order to dig soil etc. and dump the dug soil through the combined operation of the swing and the bucket in the same manner as in the above description. In this case, the pump torques of the first and second hydraulic pumps are increased by the first torque control unit so as to increase the flow rate of the pressure oil supplied from the first hydraulic pump to the bucket cylinder. Thus, the operating speed of the bucket cylinder can be increased. That is, the operation of bucket crowding is performed at a high operating speed till the upperstructure and the bucket return to the digging site. Thus, the bucket can be resumed to a working posture preferable for digging with a predetermined biting angle of its blade edge with respect to the ground. In this manner, it is possible to improve the working efficiency in the digging work.

Advantageous Effects of Invention

According to the invention, configuration is made so that a first boom directional control valve and a second arm directional control valve are connected in parallel to a first hydraulic pump, a second boom directional control valve and a first arm directional control valve are connected in parallel to a second hydraulic pump, a third hydraulic pump is provided, a third boom directional control valve is connected to the third hydraulic pump, and a third arm directional control valve is connected in tandem with the third boom directional control valve.

Due to this configuration, according to the invention, during the combined operation of boom raising and arm crowding, the boom raising can be performed by pressure oil of the third hydraulic pump, and the arm crowding can be performed with a sufficient flow rate of pressure oil supplied from the first hydraulic pump and the second hydraulic pump. That is, according to the invention, the combined operation of boom raising and arm crowding can be performed without providing a throttle on the upstream side of an arm directional control valve as in the background art. In addition, according to the invention, during the operation of arm crowding, the operation of arm crowding can be performed by the pressure oil from the first hydraulic pump and the pressure oil from the second hydraulic pump as described above. That is, according to the invention, during the operation of arm crowding, the operation of arm crowding can be performed without providing a regenerative circuit having a throttle as in the background art. Thus, according to the invention, the pressure loss in the combined operation of boom raising and arm crowding and the pressure loss in the operation of arm crowding can be reduced in comparison with those in the background art. Thus, according to the invention, it is possible to improve the pump efficiency, reduce the fuel consumption and save the energy as compared with those in the background art.

DESCRIPTION OF EMBODIMENTS

Embodiments of a hydraulic drive device for a working machine according to the invention will be described below with reference to the drawings.

Figure 1:
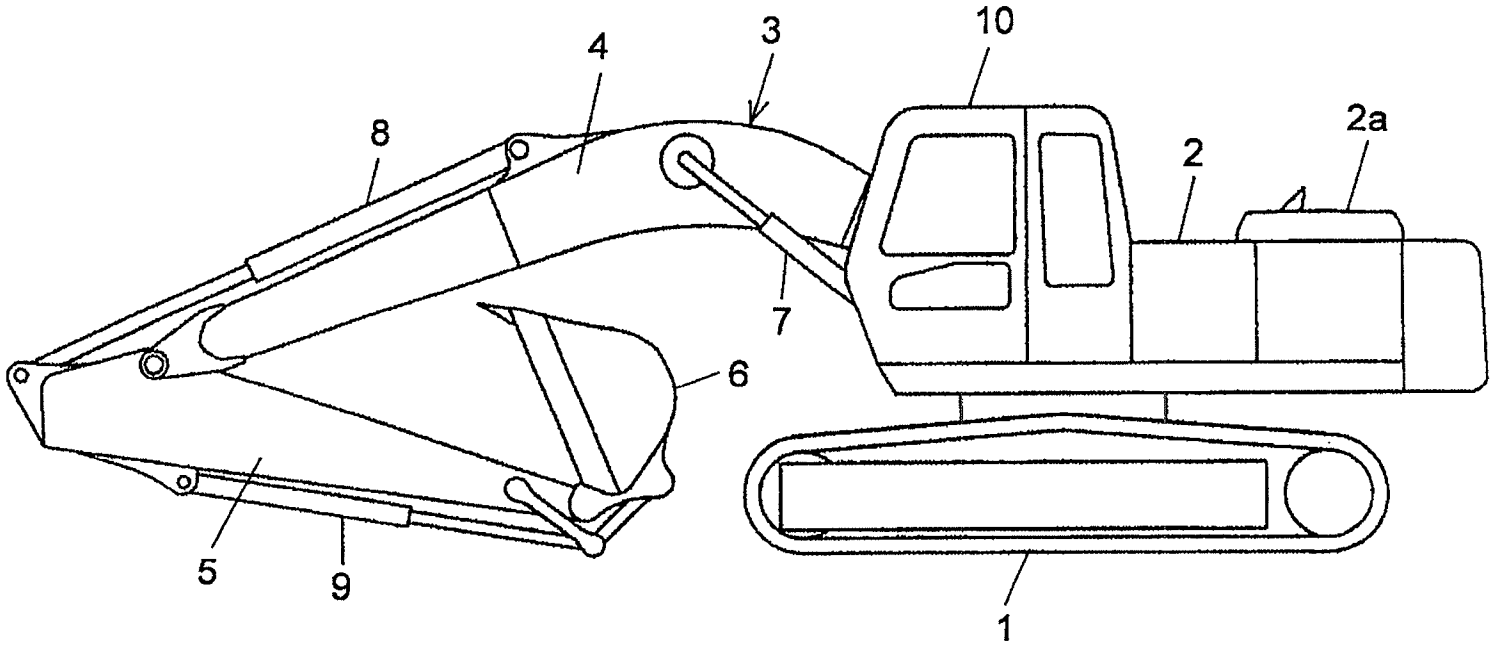
FIG. 1 A side view showing a hydraulic excavator as an example of a working machine provided with a first embodiment of a hydraulic drive device according to the invention.

A hydraulic drive device according to a first embodiment of the invention is, for example, for a hydraulic excavator capable of performing soil digging work. As shown in FIG. 1, the hydraulic excavator has an undercarriage 1, an upperstructure 2 disposed on the undercarriage 1, and a working device 3 attached to the upperstructure 2. A body is constituted by the undercarriage 1 and the upperstructure 2. The working device 3 includes a boom 4 which is connected to the upperstructure 2 so as to be rotatable in an up/down direction, an arm 5 which is connected to a distal end of the boom 4 so as to be rotatable in the up/down direction, and a bucket 6 which is connected to a distal end of the arm 5 so as to be rotatable in the up/down direction. The working device 3 also includes a boom cylinder 7 which drives the boom 4, an arm cylinder 8 which drives the arm 5, and a bucket cylinder 9 which drives the bucket 6. An operating cab 10 is disposed on the upperstructure 2. An engine room 2*a* in which an engine and hydraulic pumps which will be described later are received is provided at the rear of the operating cab 10.

Figure 2:
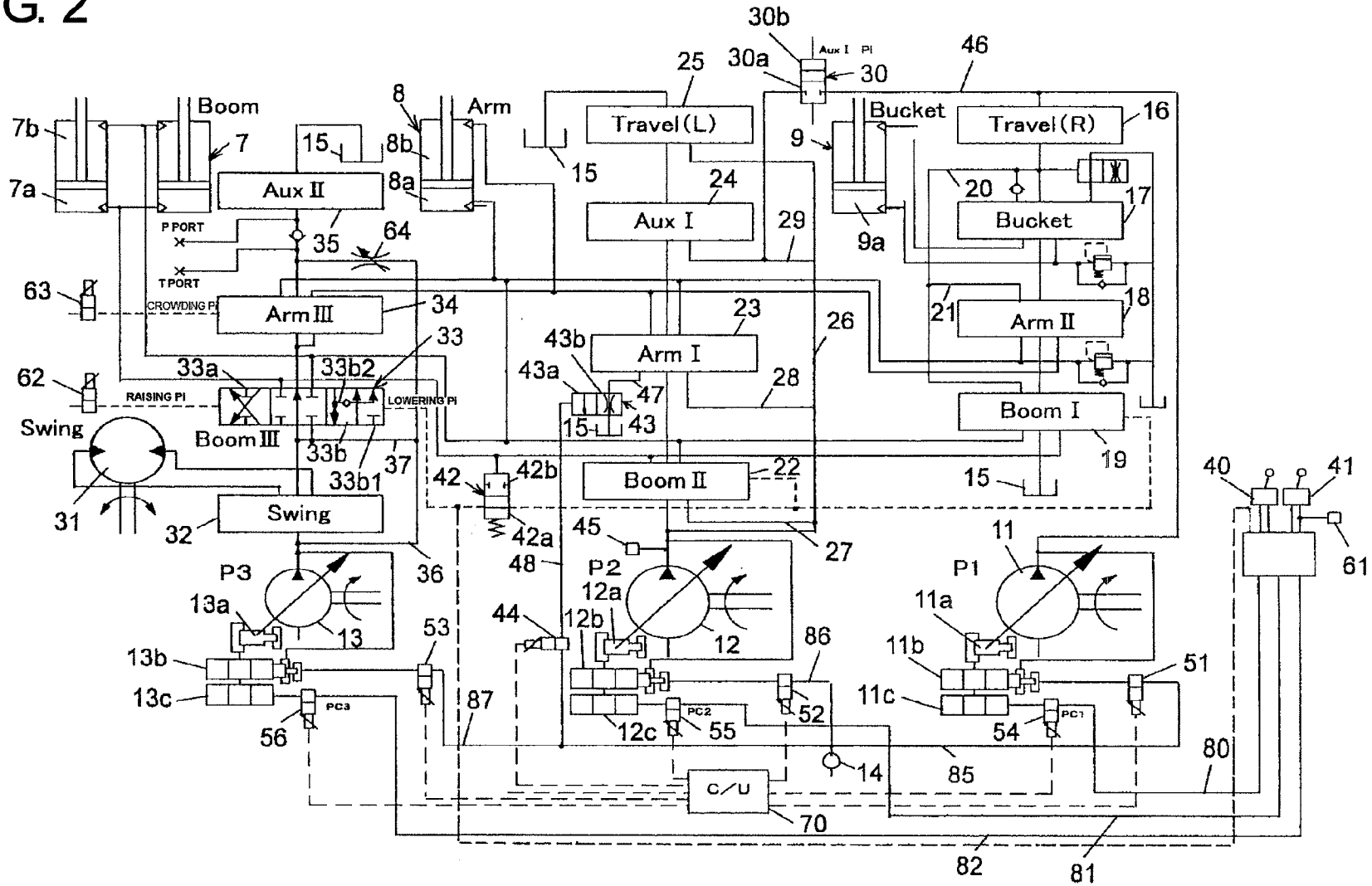
FIG. 2 An electric/hydraulic circuit diagram showing the first embodiment of the invention.

The hydraulic drive device according to the first embodiment provided in the hydraulic excavator shown in FIG. 1 has three main hydraulic pumps which are driven by a not-shown engine, for example, a first hydraulic pump 11, a second hydraulic pump 12 and a third hydraulic pump 13 which consist of variable displacement hydraulic pumps respectively, as shown in FIG. 2. In addition, the hydraulic drive device also has a pilot pump 14 which is driven by the not-shown engine, and a tank 15 from which oil is supplied to the first to third hydraulic pumps 11 to 13 and the pilot pump 14.

The swash angle of the first hydraulic pump 11 is controlled by a regulator which is additionally provided in the first hydraulic pump 11. The regulator of the first hydraulic pump 11 includes a control piston 11*a*, a torque adjustment valve 11*b* and a flow rate adjustment valve 11*c*. In the same manner, the swash angle of the second hydraulic pump 12 is controlled by a regulator which is additionally provided in the second hydraulic pump 12. The regulator of the second hydraulic pump 12 includes a control piston 12*a*, a torque adjustment valve 12*b* and a flow rate adjustment valve 12*c*. In addition, in the same manner, the swash angle of the third hydraulic pump 13 is controlled by a regulator which is additionally provided in the third hydraulic pump 13. The regulator of the third hydraulic pump 13 includes a control piston 13*a*, a torque adjustment valve 13*b* and a flow rate adjustment valve 13*c*.

A right travel directional control valve 16 which controls driving of a not-shown right one of a pair of travel motors for driving the undercarriage 1 is connected to the first hydraulic pump 11 on the most upstream side. A bucket directional control valve 17 which is connected to the bucket cylinder 9 so as to control the flow of pressure oil, a second arm directional control valve 18 which controls the flow of pressure oil supplied to the arm cylinder 8, and a first boom directional control valve 19 which controls the flow of pressure oil supplied to the boom cylinder 7 are connected to the downstream side of the right travel directional control valve 16. The bucket directional control valve 17, the second arm directional control valve 18 and the first boom directional control valve 19 are connected in parallel with one another through a pipe line 20 connected to the right travel directional control valve 16, and a pipe line 21 connected to the pipe line 20.

A second boom directional control valve 22 which controls the flow of pressure oil supplied to the boom cylinder 7, a first arm directional control valve 23 which controls the flow of pressure oil supplied to the arm cylinder 8, a first auxiliary directional control valve 24 which controls the flow of pressure oil supplied to a not-shown first actuator for driving a first special attachment such as a secondary crusher provided in place of the bucket 6, a left travel directional control valve 25 which controls driving of a not-shown left one of the pair of travel motors for driving the undercarriage 1 are connected to the second hydraulic pump 12. The second boom directional control valve 22, the first arm directional control valve 23, the first auxiliary directional control valve 24 and the left travel directional control valve 25 are connected in parallel with one another through a pipe line 26 connected to the second hydraulic pump 12, and pipe lines 27, 28 and 29 connected to the pipe line 26.

The first hydraulic pump 11 and an input port of the first auxiliary directional control valve 24 are connected through a pipe line 46 connected to the first hydraulic pump 11. An auxiliary flow combiner valve 30 which can supply the pressure oil discharged from the first hydraulic pump 11 to the first auxiliary directional control valve 24 is provided in the pipe line 46. The auxiliary flow combiner valve 30 cannot supply the pressure oil of the first hydraulic pump 11 to the first auxiliary directional control valve 24 when the auxiliary flow combiner valve 30 is held in a closed position 30*a*. When the auxiliary flow combiner valve 30 is changed over to an open position 30*b*, the pressure oil of the first hydraulic pump 11 can be combined with the pressure oil of the second hydraulic pump 12 and supplied to the first auxiliary directional control valve 24. For example, when a not-shown first auxiliary operating device is operated, the auxiliary flow combiner valve 30 may be changed over to the open position 30*b* in accordance with the operation of the first auxiliary operating device, for example, in response to an operation signal (pilot pressure) of the first auxiliary operating device supplied to the auxiliary flow combiner valve 30. When the first auxiliary operating device is not operated, the auxiliary flow combiner valve 30 may be changed over to the closed position 30*a*. Alternatively, the auxiliary flow combiner valve 30 may be selected in accordance with the operation of a switch or the like provided separately.

A swing directional control valve 32 which controls the flow of pressure oil supplied to a swing motor 31 for driving the upperstructure 2, a third boom directional control valve 33 which controls the flow of pressure oil supplied to the boom cylinder 7, a third arm directional control valve 34 which controls the flow of pressure oil supplied to the arm cylinder 8, and a second auxiliary directional control valve 35 which controls the flow of pressure oil supplied to a not-shown second actuator when a second special attachment is further provided in addition to the first special attachment or a second special attachment provided with two hydraulic actuators, i.e. first and second hydraulic actuators is mounted in place of the first special actuator are connected to the third hydraulic pump 13.

The swing directional control valve 32, the third boom directional control valve 33 and the second auxiliary directional control valve 35 are connected in parallel with one another through a pipe line 36 connected to the third hydraulic pump 13, and a pipe line 37 connected to the pipe line 36. On the other hand, the third arm directional control valve 34 is connected in tandem with the third boom directional control valve 33 on the downstream side. A variable throttle 64 is provided in a portion of the pipe line 36 on the meter-in side of the second auxiliary directional control valve 35. In addition, the second auxiliary directional control valve 35 is provided with an additional pump port to which a not-shown additional pump can be connected. A check valve is provided on the upstream side of the additional pump port, and a tank port is provided further on the upstream side of the check valve. By the check valve, pressure oil supplied from the additional pump port can be blocked from being distributed to the tank port.

The third boom directional control valve 33 has a boom raising selection position 33*a* which is a selection position to rotate the boom 4 upward, a boom lowering selection position 33*b* which is a selection position to rotate the boom 4 downward, and a neutral position to block the communication between the third hydraulic pump 13 and the boom cylinder 7 and form an oil path where pressure oil discharged from the third hydraulic pump 13 can be introduced to the third arm directional control valve 34. A block port 33*b*1 by which the pressure oil discharged from the third hydraulic pump 13 can be blocked from being supplied to the boom cylinder 7 is provided in the boom lowering selection position 33*b* of the third boom directional control valve 33. On the other hand, a regenerative circuit 33*b*2 by which oil discharged from a bottom chamber 7*a* of the boom cylinder 7 during the operation of boom lowering can be regeneratively supplied to a rod chamber 7*b*, and an oil path where the pressure oil discharged from the third hydraulic pump 13 can be introduced to the third arm control valve 34 are provided in the boom lowering selection position 33*b*.

In the first embodiment, there are provided a boom operating device 40 which can perform selection operation on the first boom directional control valve 19, the second boom directional control valve 22 and the third boom directional control valve 33 individually, and an arm operating device 41 which can perform selection operation on the first arm directional control valve 23, the second arm directional control valve 18 and the third arm directional control valve 34 individually. A pressure sensor 61 (pilot pressure sensor) for detecting that the operation of arm crowding has been performed is provided in the arm operating device 41.

Since explanation is complicated, a bucket operating device for operating to select the bucket directional control valve 17, a swing operating device for operating to select the swing directional control valve 32, a right travel operating device for operating to select the right travel directional control valve 16, a left travel operating device for operating to select the left travel directional control valve 25, a first auxiliary operating device for operating to select the first auxiliary directional control valve 24, and a second auxiliary operating device for operating to select the second auxiliary directional control valve 35 are not shown in the drawings.

In addition, in the first embodiment, there is provided a boom directional control valve control unit, that is, a selector valve 42 which is schematically depicted in FIG. 2. When the bottom pressure of the boom cylinder 7 reaches a predetermined pressure or higher at the time of boom lowering in the air, the selector valve 42 holds the third boom directional control valve 33 in the boom lowering selection position 33*b* and the first boom directional control valve 19 and the second boom directional control valve 22 in the neutral positions. When the bottom pressure of the boom cylinder 7 does not reach the aforementioned predetermined pressure during the operation of boom lowering in the state where the boom is on the ground, that is, during the jack-up operation, the selector valve 42 holds the third boom directional control valve 33 in the neutral position, the first boom directional control valve 19 in the boom lowering selection position where the pressure oil discharged from the first hydraulic pump 11 can be supplied to the rod chamber 7*b* of the boom cylinder 7, and the second boom directional control valve 22 in the boom lowering selection position where the pressure oil discharged from the second hydraulic pump 12 can be supplied to the rod chamber 7*b* of the boom cylinder 7.

The selector valve 42 is changed over to a closed position 42*b* against the force of a spring due to the bottom pressure of the boom cylinder 7 when the bottom pressure reaches the predetermined pressure or higher. As a result, when the boom operating device 40 is operated on the boom lowering side, the third boom directional control valve 33 can be held in the boom lowering selection position 33*b*, and the first boom directional control valve 19 and the second boom directional control valve 22 can be held in the neutral positions. On the contrary, when the bottom pressure of the boom cylinder 7 does not reach the predetermined pressure, the selector valve 42 is changed over to an open position 42*a* by the force of the spring. As a result, when the boom operating device 40 is operated on the boom lowering side, the third boom directional control valve 33 can be held in the neutral position, and the first boom directional control valve 19 and the second boom directional control valve 22 can be held in the boom lowering selection positions respectively.

In addition, in the first embodiment, an open valve 43 whose opening amount is kept small when the arm 5 is not operated and whose opening amount increases as the operation amount of the arm 5 increases at the time of arm crowding is provided in a return pipe line connecting at least one of the first arm directional control valve 23, the second arm directional control valve 18 and the third arm directional control valve 34 to the tank 15, for example, a return pipe line 47 connecting the first arm directional control valve 23 to the tank 15.

An electromagnetic valve 44 for opening/closing a pipe line 48 which connects the pilot pump 14 to a control portion of the open valve 43 is provided in the pipe line 48. When the electromagnetic valve 44 is held to close in accordance with a signal outputted from a controller 70, the open valve 43 is held in a right position 43*b* having a throttle. When the electromagnetic valve 44 is selected to be open in accordance with a signal outputted from a controller 70, the pilot pressure of the pilot pump 14 is supplied to the control portion of the open valve 43 so that the open valve 43 is changed over to a left position 43*a* which is a full open position.

In addition, in the first embodiment, there is provided a discharge pressure detection unit, i.e. a discharge pressure sensor 45, which detects at least the discharge pressure of the second hydraulic pump 12 of the discharge pressure of the first hydraulic pump 11, the discharge pressure of the second hydraulic pump 12 and the discharge pressure of the third hydraulic pump 13. The controller 70 includes a directional control valve neutral holding unit by which a signal to hold the third boom directional control valve 33 and the third arm directional control valve 34 in the neutral positions when the discharge pressure detected by the discharge pressure sensor 45 is not lower than a predetermined pressure corresponding to a large digging force for the work of heavy duty digging is outputted to an electromagnetic valve 62 and an electromagnetic valve 63 which are schematically depicted in FIG. 2. In addition, in the first embodiment, the controller 70 includes a not-shown pump control cancel unit which cancels pump swash angle control on the third hydraulic pump 13 during the work of heavy duty digging when the discharge pressure of the second hydraulic pump 12 reaches the aforementioned predetermined pressure or higher.

In addition, in the first embodiment, there is also provided a not-shown third hydraulic pump swash angle control unit which keeps the pump swash angle control on the third hydraulic pump 13 not executed during the operation of arm crowding.

In addition, in the first embodiment, there is also provided a first flow rate limit control unit which limits a flow rate discharged from the first hydraulic pump 11 to a predetermined flow rate lower than a maximum flow rate which can be discharged by the first hydraulic pump 11, for example, a first flow rate limit control valve 54 which is provided in a pipe line 80 connecting various operating devices including the boom operating device 40 and the arm operating device 41 to the control portion of the flow rate adjustment valve 11*c*, and which consists of an electromagnetic valve operating in accordance with a control signal outputted from the controller 70. In addition, there is provided a second flow rate limit control unit which limits a flow rate discharged from the second hydraulic pump 12 to a predetermined flow rate lower than a maximum flow rate which can be discharged by the second hydraulic pump 12, for example, a second flow rate limit control valve 55 which is provided in a pipe line 81 connecting the various operating devices including the boom operating device 40 and the arm operating device 41 to the control portion of the flow rate adjustment valve 12*c*, and which consists of an electromagnetic valve operating in accordance with a control signal outputted from the controller 70. In addition, there is provided a third flow rate limit control unit which limits a flow rate discharged from the third hydraulic pump 13 to a predetermined flow rate lower than a maximum flow rate which can be discharged by the third hydraulic pump 13, for example, a third flow rate limit control valve 56 which is provided in a pipe line 82 connecting the various operating devices including the boom operating device 40 and the arm operating device 41 to the control portion of the flow rate adjustment valve 13*c*, and which consists of an electromagnetic valve operating in accordance with a control signal outputted from the controller 70.

In addition, in the first embodiment, there is also provided a first torque control unit which can control the pump torque of the first hydraulic pump 11 variably, for example, a first torque control valve 51 which is provided in a pipe line 85 connecting the pilot pump 14 to the control portion of the torque adjustment valve 11*b*, and which consists of an electromagnetic valve controlling the opening amount of the pipe line 85 in accordance with a control signal outputted from the controller 70. In addition, there is provided a second torque control unit which can control the pump torque of the second hydraulic pump 12 variably, for example, a second torque control valve 52 which is provided in a pipe line 86 connecting the pilot pump 14 to the control portion of the torque adjustment valve 12*b*, and which consists of an electromagnetic valve controlling the opening amount of the pipe line 86 in accordance with a control signal outputted from the controller 70. In addition, there is provided a third torque control unit which can control the pump torque of the third hydraulic pump 13 variably, for example, a third torque control valve 53 which is provided in a pipe line 87 connecting the pilot pump 14 to the control portion of the torque adjustment valve 13*b*, and which consists of an electromagnetic valve controlling the opening amount of the pipe line 87 in accordance with a control signal outputted from the controller 70.

In the hydraulic drive device according to the first embodiment configured thus, for example, various operations and controls can be performed as follows.

[Combined Operation of Boom Raising and Arm Crowding]

In the first embodiment, when the boom operating device 40 and the arm operating device 41 are operated for the combined operation of boom raising and arm crowding, the first boom directional control valve 19 and the second boom directional control valve 22 are changed over to not-shown boom raising selection positions, and the third boom directional control valve 33 is changed over to the boom raising selection position 33*a*. The first arm directional control valve 23, the second arm directional control valve 18 and the third arm directional control valve 34 are changed over to not-shown arm crowding selection positions respectively. The first boom directional control valve 19 and the second arm directional control valve 18 are connected in parallel to the first hydraulic pump 11 and the second boom directional control valve 22 and the first arm directional control valve 23 are connected in parallel to the second hydraulic pump 12. However, the third boom directional control valve 33 and the second arm directional control valve 34 are connected in tandem to the third hydraulic pump 13 so that the third boom directional control valve 33 is connected on the upstream side. Therefore, the pressure oil discharged from the third hydraulic pump 13 can be made to flow to the third boom directional control valve 33 by priority. Thus, boom raising can be performed with the pressure oil of the third hydraulic pump 13 supplied to the bottom chamber 7*a* of the boom cylinder 7 through the boom raising selection position 33*a* of the third boom directional control valve 33, while arm crowding can be performed with a sufficient flow rate of the pressure oil of the first hydraulic pump 11 supplied to the bottom chamber 8*a* of the arm cylinder 8 through the second arm directional control valve 18 and a sufficient flow rate of the pressure oil of the second hydraulic pump 12 supplied to the bottom chamber 8*a* of the arm cylinder 8 through the first arm directional control valve 23. That is, the combined operation of boom raising and arm crowding can be performed without providing a throttle on the upstream side of an arm directional control valve. In addition, the operation of arm crowding can be performed without providing a regenerative circuit having a throttle. Thus, the pressure loss in the combined operation of boom raising and arm crowding and the pressure loss in the operation of arm crowding can be reduced, so that good controllability can be secured while the pump efficiency is improved.

[Combined Operation of Swing, Boom and Arm]

In the first embodiment, when a not-shown swing operating device, the boom operating device 40 and the arm operating device 41 are operated for the combined operation of swing, boom and arm, the swing directional control valve 32, the first to third boom directional control valves 19, 22 and 33 and the first to third arm directional control valves 23, 18 and 34 are changed over to selection positions corresponding to the operating directions. On this occasion, the swing directional control valve 32 and the third boom directional control valve 33 are connected in parallel to the third hydraulic pump 13, and the third arm directional control valve 34 is connected in tandem with the swing directional control valve 32 and the third boom directional control valve 33 on the downstream side. Accordingly, the pressure oil of the third hydraulic pump 13 is supplied to the swing motor 31 through the swing directional control valve 32 and to the boom cylinder 7 through the third boom directional control valve 33. Since the upperstructure 2 is a large inertial body, a large load is applied to the swing motor 31 at the time of start-up, but the load tends to decrease in accordance with acceleration after the start-up. On the other hand, a load on the boom cylinder 7 is large as described previously. Therefore, based on the relation between those loads, the pressure oil discharged from the third hydraulic pump 13 is supplied to the swing motor 31 and the boom cylinder 7 through the swing directional control valve 32 and the third boom directional control valve 33. On the other hand, the pressure oil of the first hydraulic pump 11 and the pressure oil of the second hydraulic pump 12 are also supplied based on the loads on the boom cylinder 7 and the arm cylinder 8 because the first boom directional control valve 19 and the second arm directional control valve 18 are connected in parallel and the second boom directional control valve 22 and the first arm directional control valve 23 are connected in parallel. That is, the pressure oil of the first hydraulic pump 11 is supplied to the boom cylinder 7 through the first boom directional control valve 19 or to the arm cylinder 8 through the second arm directional control valve 18. Further, the pressure oil of the second hydraulic pump 12 is supplied to the boom cylinder 7 through the second boom directional control valve 22 or to the arm cylinder 8 through the first arm directional control valve 23. Thus, good controllability in the combined operation of swing, boom and arm can be secured.

[Independence of Swing in Combined Operation of Boom Lowering and Swing]

In the first embodiment, when the not-shown swing operating device and the boom operating device 40 are operated for the combined operation of boom lowering and swing, the swing directional control valve 32 is selected and the third boom directional control valve 33 is changed over to the boom lowering selection position 33*b*. The swing directional control valve 32 and the third boom directional control valve 33 are connected in parallel to the third hydraulic pump 13. However, a block port 33*b*1 is provided in the boom lowering selection position 33*b* of the third boom directional control valve 33 so that the pressure oil supplied from the third hydraulic pump 13 can be blocked by the block port 33*b*1. Accordingly, the full amount of the oil discharged from the third hydraulic pump 13 is supplied to the swing directional control valve 32 so that the pressure oil of the third hydraulic pump 13 can be supplied only to the swing motor 31 through the swing directional control valve 32. Thus, the independence of the swing motor can be secured. That is, the swing can be operated independently without being affected by the operation of boom lowering, so that good acceleration and controllability in the swing can be secured.

[Combined Operation of Boom Raising and Swing]

In the first embodiment, when the boom operating device 40 and the not-shown swing operating device are operated for the combined operation of boom raising and swing, the first to third boom directional control valves 19, 22 and 33 are changed over to the boom raising selection positions 33*a*, and the swing directional control valve 32 is selected. The pressure oils of the first and second hydraulic pumps 11 and 12 are supplied to not-shown boom raising selection positions of the first and second boom directional control valves 19 and 22 respectively, and the pressure oil of the third hydraulic pump 13 is supplied to the boom raising selection position 33*a* of the third boom directional control valve 33 and the swing directional control valve 32 connected in parallel, so that the pressure oil can be supplied to both the boom cylinder 7 and the swing motor 31 through those directional control valves 33 and 32. On this occasion, due to a large load applied to the swing motor 31 at the time of start-up as described above, a part of the pressure oil which cannot be supplied to the swing motor 31, of the pressure oil discharged from the third hydraulic pump 13 is supplied to the third boom directional control valve 33 through the pipe line 37. Thus, the combined operation of boom raising and swing can be performed while the swing speed is restrained from increasing too much relatively to the boom raising. Thus good controllability in the combined operation of boom raising and swing can be secured.

[Combined Operation of Arm (Crowding/Dumping) and Swing]

In the first embodiment, when the arm operating device 41 and the not-shown swing operating device are operated for the combined operation of arm crowding/dumping and swing, the first to third arm directional control valves 23, 18 and 34 are changed over to not-shown arm crowding selection positions or arm dumping selection positions corresponding to the operation, and the swing directional control valve 32 is changed over to a predetermined selection position corresponding to the operation. The pressure oil of the first hydraulic pump 11 and the pressure oil of the second hydraulic pump 12 are supplied to the first and second arm directional control valves 23 and 18 respectively. The swing directional control valve 32 and the third arm directional control valve 34 are connected in tandem, and the swing directional control valve 32 is provided on the upstream side of the third arm directional control valve 34 with respect to the third hydraulic pump 13. Accordingly, the pressure oil of the third hydraulic pump 13 is supplied only to the swing directional control valve 32. Thus, the independence of the swing motor can be secured. That is, swing can be operated independently without being affected by the operation of the arm. Thus, good acceleration and controllability in the swing can be secured.

[Combined Operation of Boom Raising, Arm Crowding and Bucket Crowding]

In the first embodiment, when the boom operating device 40, the arm operating device 41 and the not-shown bucket operating device are operated for the combined operation of boom raising, arm crowding and bucket crowding, the first and second boom directional control valves 19 and 22 are changed over to not-shown boom raising selection positions, the third boom directional control valve 33 is changed over to the boom raising selection position 33*a*, the first to third arm directional control valves 23, 18 and 34 are changed over to not-shown arm crowding selection positions, and the bucket directional control valve 17 is changed over to a bucket crowding selection position. As described above, the third boom directional control valve 33 and the third arm directional control valve 34 are connected in tandem to the third hydraulic pump 13, and the third boom directional control valve 33 is provided on the upstream side of the third arm directional control valve 34. Accordingly, the pressure oil of the third hydraulic pump 13 is supplied only to the third boom directional control valve 33 regardless of loads.

On the other hand, the pressure oil of the first hydraulic pump 11 is supplied to the bucket directional control valve 17, the second arm directional control valve 18 and the first boom directional control valve 19 connected in parallel, and the pressure oil of the second hydraulic pump 12 is supplied to the second boom directional control valve 22 and the first arm directional control valve 23 connected in parallel, respectively in accordance with loads. As a result, while the operation of boom raising with a large load is ensured without the aid of a throttle, good combined operation of boom raising, arm crowding and bucket crowding can be performed, and the pressure loss during the combined operation can be reduced.

[Combined Operation of Travel and Boom Raising]

In the first embodiment, when a no-shown travel operating device and the boom operating device 40 are operated for the combined operation of travel and boom raising, the right travel directional control valve 16 and the left travel directional control valve 25 are changed over to a forward selection position or a backward selection position corresponding to the operation, the first and second boom directional control valves 19 and 22 are changed over to not-shown boom raising selection positions, and the third boom directional control valve 33 is changed over to the boom raising selection position 33*a*. The third boom directional control valve 33 is provided for the third hydraulic pump 13 independently of the left and right travel directional control valves 16 and 25 so that the pressure oil can be supplied to the boom cylinder 7 for the boom regardless of the influence of a travel load. Thus, good combined operation of travel and boom raising can be performed.

[Operation of First Special Attachment]

In the first embodiment, when a not-shown first auxiliary operating device is operated, the first auxiliary directional control valve 24 is selected. When the auxiliary flow combiner valve 30 is held in the closed position 30*a* on this occasion, the pressure oil of the second hydraulic pump 12 is supplied to a not-shown first actuator through the first auxiliary directional control valve 24, so that the first special attachment can be driven by the operation of the first actuator. In order to drive the first special attachment at a high operating speed, the first auxiliary directional control valve 24 may be selected in the state where the auxiliary flow combiner valve 30 has been changed over to the open position 30*b*. Thus, the pressure oil of the first hydraulic pump 11 is combined with the pressure oil of the second hydraulic pump 12 and supplied to the first auxiliary directional control valve 24 through the pipe line 46 and the auxiliary flow combiner valve 30. That is, the combined pressure oil of the first hydraulic pump 11 and the second hydraulic pump 12 is supplied to the not-shown first actuator so that the first special attachment can be driven at a high operating speed.

At the time of the combined operation of the first special attachment, the boom 4 and the arm 5, for example, the pressure oil of the second hydraulic pump 12 is supplied to the first auxiliary directional control valve 24 or the pressure oil of the first hydraulic pump 11 and the pressure oil of the second hydraulic pump 12 are combined and supplied to the first auxiliary directional control valve 24 so as to operate the first actuator to thereby drive the first special attachment, while the pressure oil of the third hydraulic pump 13 is supplied to the boom cylinder 7 or the arm cylinder 8 through the third boom directional control valve 33 or the third arm directional control valve 34 so that the boom 4 or the arm 5 can be driven. That is, when the combined operation of the first special attachment, the boom 4 and the arm 5 is performed in this manner, the combined operation can be performed without the aid of a throttle. Therefore, there is no fear that a pressure loss caused by the throttle may be generated.

[Operation of Second Special Attachment]

In the first embodiment, when a not-shown second auxiliary operating device is operated, the second auxiliary directional control valve 35 is selected so that the pressure oil of the third hydraulic pump 13 can be supplied to a not-shown second actuator through the second auxiliary directional control valve 35 to thereby drive the second special attachment. In addition, the second auxiliary directional control valve 35 is connected in parallel with the swing directional control valve 32 and the third boom directional control valve 35 and to the third hydraulic pump. Therefore, the second auxiliary directional control valve 35 can be operated even when the swing and the boom are operated concurrently. The second auxiliary directional control valve 35 may be exchanged easily for a second bucket directional control valve for accelerating the bucket 6 without the necessity of additional provision of a pipe line. When the second bucket directional control valve is provided in place of the second auxiliary directional control valve 35 in this manner, the pressure oil of the third hydraulic pump 13 can be combined with the pressure oil of the first hydraulic pump 11 through the second bucket directional control valve and supplied to the bucket cylinder 9. Thus, the increase in the operating speed of the bucket 6 can be achieved.

[Combined Operation of Swing and Second Special Attachment]

In the first embodiment, when the not-shown swing operating device and the not-shown second auxiliary operating device are operated, the swing directional control valve 33 and the second auxiliary directional control valve 35 are selected. As a result, the pressure oil of the third hydraulic pump 13 is supplied to both the swing directional control valve 32 and the second auxiliary directional control valve 35 connected in parallel so as to operate the swing motor 31 to thereby swing the upperstructure 2, and to operate the not-shown second actuator to thereby drive the second special attachment. Thus, the combined operation of the swing and the second special attachment can be performed. In addition, when the opening amount of the variable throttle 64 is adjusted in accordance with the level of the load pressure on the second actuator with respect to the load pressure on the swing motor 31 on this occasion, the flow rates supplied to the swing motor 31 and the second actuator can be distributed suitably. Thus, good controllability in the combined operation can be secured.

[Independent Circuit of Second Special Attachment]

In the first embodiment, when a pipe line portion connecting the third hydraulic pump 13 with the second auxiliary directional control valve 35 is blocked and a not-shown additional hydraulic pump is connected to an additional pump port of the second auxiliary directional control valve 35 through a pipe arrangement, the pressure oil of the additional hydraulic pump can be supplied to the not-shown second actuator through the second auxiliary directional control valve 35 so as to drive the second special attachment. That is, the second special attachment can be driven independently of the operation of the swing, the operation of the boom and the operation of the arm.

[Change of First and Second Special Attachments to Independent Circuits]

In the first embodiment, the second boom directional control valve 22, the first arm directional control valve 23 and the first auxiliary directional control valve 24 which are connected to the second hydraulic pump 12 are connected in parallel. Therefore, the placement of the swing directional control valve 32 and the placement of the first auxiliary directional control valve 24 can be exchanged for each other easily without the necessity of additional pipe arrangements. When the swing directional control valve 32 and the first auxiliary directional control valve 24 are exchanged for each other in this manner, the first auxiliary directional control valve 24 and the second auxiliary directional control valve 35 are connected to the third hydraulic pump 13 so that the pressure oil of the third hydraulic pump 13 can be used exclusively for the first and second special attachments. Thus, the pressure oil of the second hydraulic pump 12 can be supplied to the swing motor 31 through the swing directional control valve 32 to thereby swing the upperstructure 2, while drive circuits for the first and second special attachments controlled by the first and second auxiliary directional control valves 24 and 35 can be made independent and driven by the pressure oil of the third hydraulic pump 13.

[Regenerative Operation During Boom Lowering]

In the first embodiment, when the boom operating device 40 is operated to perform boom lowering in the state where the boom 4 is retained in the air, the boom 4 moves down due to its own weight. On this occasion, the bottom pressure of the boom cylinder 7 reaches a predetermined pressure or higher because the boom is retained. Due to the bottom pressure not lower than the predetermined pressure, the selector valve 42 is changed over to the closed position 42*b* as described above. When the selector valve 42 is changed over to the closed position 42*b*, the supply of the pilot pressure to the control portion of the first boom directional control valve 19 and the control portion of the second boom directional control valve 22 is blocked. Thus, the first boom directional control valve 19 and the second boom directional control valve 22 are held in neutral positions. On this occasion, the pilot pressure can be supplied to the control portion of the third boom directional control valve 33 in accordance with the operation of the boom operating device 40. Thus, the third boom directional control valve 33 is changed over to the boom lowering selection position 33*b*. As a result, the pressure oil discharged from the third hydraulic pump 13 is blocked from being supplied to the boom cylinder 7 by the block port 33*b*1 provided in the boom lowering selection position 33*b* of the third boom directional control valve 33. The pressure oil discharged from the bottom chamber 7*a* of the boom cylinder 7 is regeneratively supplied to the rod chamber 7*b* of the boom cylinder 7 through the regenerative circuit 33*b*2. Thus, the boom cylinder 7 can retract to carry out boom lowering without the supply of the pressure oil from the third hydraulic pump 13. That is, the pressure oil of the first hydraulic pump 11, the pressure oil of the second hydraulic pump 12 and the pressure oil of the third hydraulic pump 13 are not supplied to the boom cylinder 7, but the swash angles of those hydraulic pumps are kept minimal so that the flow rates discharged therefrom can be minimized. In this manner, the energy consumption can be limited to the minimum.

[Jack-Up Operation]

In addition, when boom lowering is carried out in the state where the boom is on the ground or the like, that is, when jack-up operation is performed, the bottom pressure of the boom cylinder 7 becomes a low pressure which is about equivalent to the tank pressure and which does not reach the aforementioned predetermined pressure. On this occasion, the selector valve 42 is in the open position 42*a* due to the force of a spring as described above, so that the pilot pressure can be supplied to the control portion of the first boom directional control valve 19 and the pilot pressure can be supplied to the control portion of the second boom directional control valve 22. In accordance with the operation of the boom operating device 40, the first boom directional control valve 19 and the second boom directional control valve 22 are changed over to boom lowering selection positions respectively, and the pilot pressure is supplied to the control portion of the third boom directional control valve 33 so that the third boom directional control valve 33 is changed over to the boom lowering selection position 33*b*. The block port 33*b*1 for blocking the supply of pressure oil from the third hydraulic pump 13 to the boom cylinder 7 and a pipe line through which the pressure oil supplied thereto is made to flow to the third arm directional control valve 34 side are provided in the boom lowering selection position 33*b*. Therefore, even when the third boom directional control valve 33 is changed over to the boom lowering selection position 33*b*, the discharge pressure of the third hydraulic pump 13 becomes a low pressure state close to the tank pressure as long as any other directional control valve connected to the third hydraulic pump 13 is not operated. Thus, in the jack-up time, the pressure oil of the first hydraulic pump 11 is supplied to the rod chamber 7*b* of the boom cylinder 7 through the first boom directional control valve 19 and the pressure oil of the second hydraulic pump 12 is supplied to the rod chamber 7*b* of the boom cylinder 7 through the second boom directional control valve 22, so that desired jack-up operation can be performed with the pressure oil from the two hydraulic pumps.

[Operation of Arm Crowding]

In the first embodiment, assume that the arm operating device 41 is operated to perform arm crowding, for example, in the state where the arm 5 has been retained in the air. In the pre-operation state where the arm operating device 41 has not yet been operated, no detection signal is outputted from the pressure sensor 61. Therefore, the electromagnetic valve 44 is closed under the control of the controller 70. Thus, the open valve 43 provided in the return pipe line 47 of the first arm directional control valve 23 is held in the right position 43*b* having a throttle. When the arm operating device 41 is operated in this state, the first arm directional control valve 23 is changed over to the arm crowding selection position, and the operation of arm crowding is detected by the pressure sensor 61. Due to the signal of the pressure sensor 61, the controller 70 makes control to open the electromagnetic valve 44. As a result, the pilot pressure of the pilot pump 14 is supplied to the control portion of the open valve 43 through the electromagnetic valve 44. Thus, the open valve 43 tends to be changed over to the left position 43*a* side in accordance with the magnitude of the pilot pressure.

Accordingly, when the operation of arm crowding is performed, the open valve 43 has a small opening amount at the beginning of the operation. Accordingly, the amount of oil returned from the rod chamber 8*b* of the arm cylinder 8 to the tank 15 through the first arm directional control valve 23 and the open valve 43 is small. The operating speed of arm crowding is suppressed to decrease in accordance therewith so that the arm 5 begins to move down slowly due to the pressure oil supplied from the second hydraulic pump 12 to the bottom chamber 8*a* of the arm cylinder 8 through the first arm directional control valve 23. As a result, impact at the beginning of the operation of arm crowding can be prevented from occurring. In addition, when the operation amount of the arm operating device 41 increases, the value of the signal supplied from the controller 70 to the electromagnetic valve 44 increases so that the opening amount of the electromagnetic valve 44 increases to change over the open valve 43 to the left position 43*a* which is a full open position. As a result, the amount of oil returned from the rod chamber 8*b* of the arm cylinder 8 to the tank 15 through the first arm directional control valve 23 and the open valve 43 increases. Thus, the operating speed of arm crowding is accelerated so that the arm 5 moves down quickly. In this manner, at the time of the operation of arm crowding, good controllability can be secured while the influence of an impact force on the boom 4 or the bucket 6 of the working device 3 or on the upperstructure 2 and the undercarriage 1 is reduced.

Incidentally, when the opening amount of the open valve 43 increases after the start of the operation of arm crowding, the rod pressure of the arm cylinder 8 decreases to be almost as low as the tank pressure. Therefore, the arm cylinder 8 can be operated with a smaller thrust force than in the case where a regenerative circuit having a throttle is provided. That is, in the first embodiment, the load pressure on the arm cylinder 8 at the time of the operation of arm crowding can be reduced. Thus, the pump efficiency of the second hydraulic pump 12 can be improved.

In the first embodiment, of the first arm directional control valve 23, the second arm directional control valve 18 and the third arm directional control valve 34, only the first arm directional control valve 23 is provided with a meter-out port which serves as a connection port to the tank.

[During Work of Heavy Duty Digging]

In the first embodiment, work at the time of heavy duty digging is carried out by the pressure oil of the first hydraulic pump 11 and the pressure oil of the second hydraulic pump 12, as described above. Generally, the volume efficiency of a hydraulic pump decreases as the discharge pressure of the hydraulic pump increases. For example, when the work of heavy duty digging requiring a large digging force is performed by the combined operation of the arm and the bucket, the discharge pressure of the second hydraulic pump 12 detected by the discharge pressure sensor 45 is not lower than a predetermined pressure corresponding to the work of heavy duty digging. Therefore, in accordance with a signal outputted from the discharge pressure sensor 45, the directional control valve neutral holding unit belonging to the controller 70 controls the electromagnetic valves 62 and 63 to hold the third boom directional control valve 33 and the third arm directional control valve 34 in the neutral positions when the discharge pressure detected by the discharge pressure sensor 45 reaches the predetermined pressure or higher. In addition, during such work of heavy duty digging, the supply of the pilot pressure to the control portion of the flow rate adjustment valve 13*c* belonging to the regulator of the third hydraulic pump 13 can be blocked by a not-shown pump control cancel unit. Thus, the swash angle of the third hydraulic pump 13 is kept at a minimum swash angle so that a minimum flow rate can be discharged from the third hydraulic pump 13. Thus, the pressure oil of the first hydraulic pump 11 is supplied to the bottom chamber 9*a* of the bucket cylinder 9 by priority through the bucket directional control valve 17, and the pressure oil of the second hydraulic pump 12 is supplied to the bottom chamber 8*a* of the arm cylinder 8. In this manner, the combined operation of the arm and the bucket at the time of the work of heavy duty digging can be performed by the pump swash angle control on the first hydraulic pump 11 and the pump swash angle control on the second hydraulic pump 12 without causing deterioration in the pump efficiency while good controllability is secured.

[Pump Control During Operation of Arm Crowding]

Like the work of leveling the ground, there is a case where the boom operation is used a little bit during the operation of arm crowding so as to perform the work of leveling the ground horizontally. When the arm operating device 41 is operated, the third arm directional control valve 34 as well as the first and second arm directional control valves 23 and 18 is changed over to the arm crowding selection position. On this occasion, the full amount of the pressure oil of the third hydraulic pump 13 is supplied to the third arm directional control valve 34 so as to be supplied to the arm cylinder 8. When the boom operating device 40 is operated a little bit in this state in accordance with the work, the discharge pressure of the third hydraulic pump 13 increases at a stroke because the third boom directional control valve 33 and the third arm directional control valve 34 are connected in tandem. When the discharge pressure of a pump increases, the volume efficiency of the pump decreases as described above. Therefore, when the operation of arm crowding is performed, a not-shown third hydraulic pump swash angle control unit is operated in accordance with the operation, so as to block the supply of the pilot pressure to the control portion of the flow rate adjustment valve 13*c* belonging to the regulator of the third hydraulic pump 13. That is, there is no fear that pump swash angle control may be performed on the third hydraulic pump. Thus, the pressure oil of the first hydraulic pump 11 is supplied to the bottom chamber 8*a* of the arm cylinder 8 through the second arm directional control valve 18, and the pressure oil of the second hydraulic pump 12 is supplied to the bottom chamber 8*a* of the arm cylinder 8 through the first arm directional control valve 23, so that the arm cylinder 8 can be operated by the pressure oil of the first hydraulic pump 11 and the pressure oil of the second hydraulic pump 12 to perform arm crowding. That is, the operation of arm crowding can be performed by the pump swash angle control on the first hydraulic pump 11 and the second hydraulic pump 12 without causing deterioration in the pump efficiency while good controllability is secured.

[Achievement of Energy Saving During Combined Operation]

In the first embodiment, in accordance with a signal outputted from the controller 70, the first flow rate limit control valve 54, the second flow rate limit control valve 55 and the third flow rate limit control valve 56 are operated selectively to control the pilot pressure supplied to the control portion of the flow rate adjustment valve 11*c* belonging to the regulator of the first hydraulic pump 11, the control portion of the flow rate adjustment valve 12*c* belonging to the regulator of the second hydraulic pump 12 and the control portion of the flow rate adjustment valve 13*c* belonging to the regulator of the third hydraulic pump 13 respectively, so as to control the swash angles of corresponding ones of the first hydraulic pump 11, the second hydraulic pump 12 and the third hydraulic pump 13, that is, the flow rates of pressure oils discharged from the corresponding hydraulic pumps. Thus, the combined operation of the arm 5 or the bucket 6 and the first special attachment or the combined operation of the arm 5 or the bucket 6 and the second special attachment can be performed with minimum necessary flow rates, so that the pump efficiency can be improved.

In addition, in accordance with a signal outputted from the controller 70, the first torque control valve 51, the second torque control valve 52 and the third torque control valve 53 are operated selectively to control the pilot pressure supplied to the control portion of the torque adjustment valve 11*b* belonging to the regulator of the first hydraulic pump 11, the control portion of the torque adjustment valve 12*b* belonging to the regulator of the second hydraulic pump 12 and the control portion of the torque adjustment valve 13*b* belonging to the regulator of the third hydraulic pump 13 respectively, so as to control the pump torques of corresponding ones of the first hydraulic pump 11, the second hydraulic pump 12 and the third hydraulic pump 13. Thus, while the total value of the pump torques is kept not to exceed the torque of the engine output, the distribution of the flow rates of the pressure oils discharged from the corresponding ones of the first hydraulic pump 11, the second hydraulic pump 12 and the third hydraulic pump 13 is kept suitable, so that the pump efficiency can be improved while good controllability in the combined operation is secured.

As described above, in accordance with the hydraulic drive device according to the first embodiment, when the combined operation of boom raising and arm crowding is performed, boom raising is performed by the pressure oil of the third hydraulic pump 13, and arm crowding is performed by the pressure oil of the first hydraulic pump 11 and the pressure oil of the second hydraulic pump 12, so that the combined operation of boom raising and arm crowding can be performed without providing a throttle. In addition, when the operation of arm crowding is performed, the operation of arm crowding can be performed without providing a regenerative circuit having a throttle. Accordingly, in the first embodiment, the pressure loss in the combined operation of boom raising and arm crowding and the pressure loss in the operation of arm crowding can be reduced. Thus, the pump efficiency is improved and the fuel consumption is reduced so that energy saving can be achieved.

Figure 3:
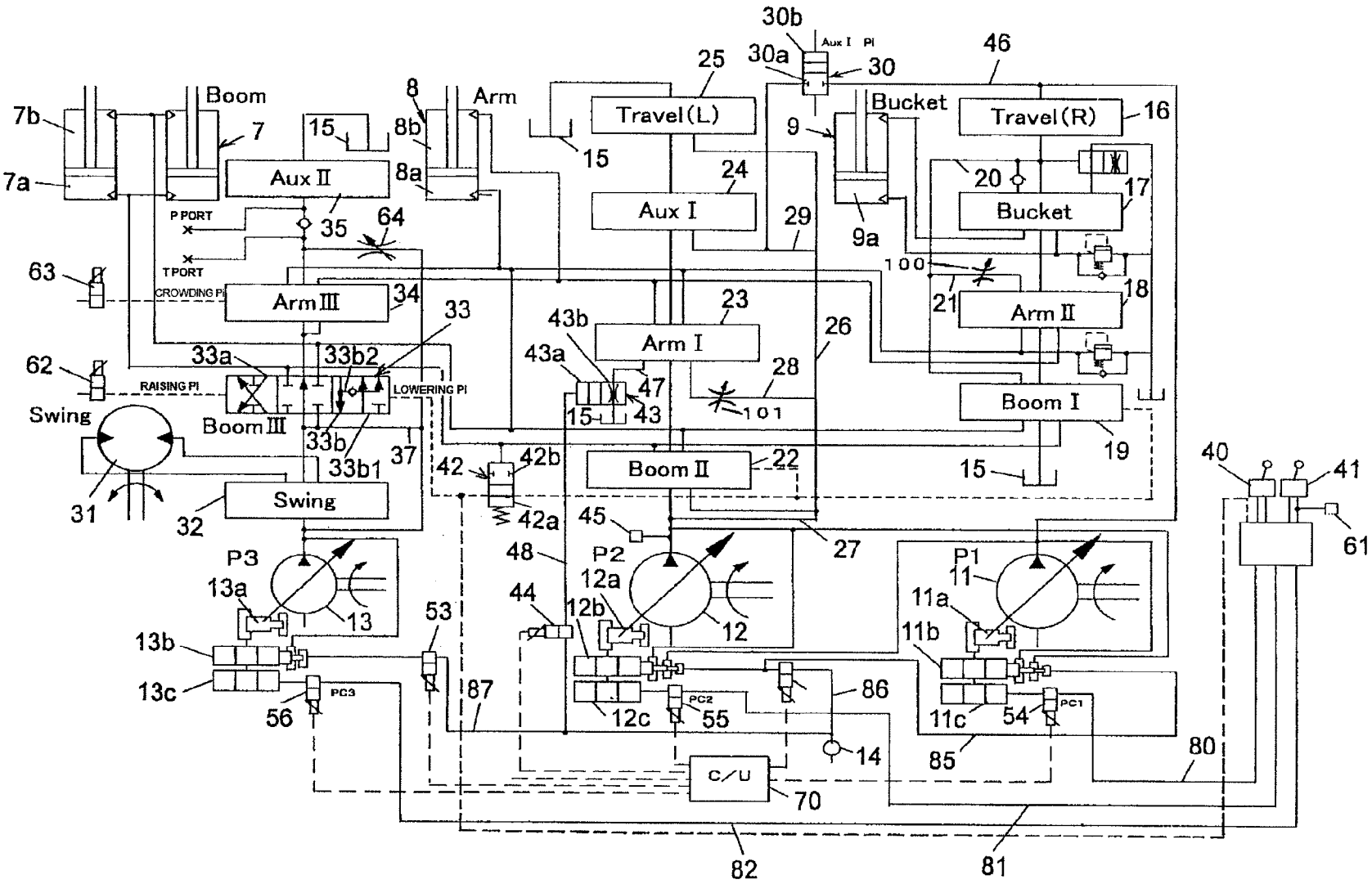
FIG. 3 An electric/hydraulic circuit diagram showing a second embodiment of the invention.

In a hydraulic drive device according to a second embodiment of the invention, configuration is made so that pump torque control on the first hydraulic pump and pump torque control on the second hydraulic pump 12 are performed by the second torque control valve 52, and the first torque control valve 51 in the first embodiment is removed, as shown in FIG. 3. When the pump torque control on the first hydraulic pump 11 and the pump torque control on the second hydraulic pump 12 are performed by one second torque control valve 52 in this manner, the number of torque control valves performing control can be reduced. Thus, pump torque control by the controller 70 can be performed more easily than in the first embodiment. The other configuration is equivalent to that in the first embodiment. In the configuration arranged as in the second embodiment, the accuracy of the pump torque control is slightly inferior to in the first embodiment, but the pump control can be performed in real work almost without causing any troubles.

Fundamentally, the second embodiment configured thus fundamentally has an equivalent configuration to that in the first embodiment. Therefore, in the same manner as in the first embodiment, the combined operation of boom raising and arm crowding can be performed without providing a throttle. In addition, the operation of arm crowding can be performed in the same manner as in the case where a regenerative circuit having a throttle is provided. As for the other operation and effect, similar operation and effect to those in the first embodiment can be obtained.

The first or second embodiment may have a configuration in which a first variable throttle 100 is provided in the pipe line 21 located on the upstream side of the second arm directional control valve 18 connected to the first hydraulic pump 11. This state is shown by reference in FIG. 3.

In such a configuration, when the combined operation of arm crowding and bucket crowding is performed, the load pressure during the operation of arm crowding is reduced due to the open valve 43 provided as described above, so that the supply of the pressure oil of the first hydraulic pump 11 to the second arm directional control valve 18 forming the low pressure side can be limited by the first variable throttle 100. Thus, the pressure oil of the first hydraulic pump 11 can be supplied to the bucket cylinder 9 by priority through the bucket directional control valve 17 and operated. In addition, the pressure oil of the second hydraulic pump 12 is supplied to the arm cylinder 8 through the first arm directional control valve 23, and the pressure oil of the third hydraulic pump 13 is supplied to the arm cylinder 8 through the third arm directional control valve 33 so that the arm cylinder 8 can be operated. That is, the operating speed of the bucket 6 can be accelerated while the operating speed of the arm 5 is secured.

The first or second embodiment may have a configuration in which a second variable throttle 101 is provided in the pipe line 28 located on the upstream side of the first arm directional control valve 23 connected to the second hydraulic pump 12. This state is shown by reference in FIG. 3.

In the configuration arranged thus, for example, assume that the first special attachment is connected to the arm 5, and the first actuator driving the first special attachment is provided as described above, so that the first actuator can be controlled by the first auxiliary directional control valve 24. In this case, for example, during the four-combined operation of boom raising, arm crowding, bucket crowding and the first special attachment, the flow of the pressure oil of the second hydraulic pump 12 to the first arm directional control valve 23 forming the low pressure side due to the open valve 43 provided in the return pipe line 47 of the first arm directional control valve 23 as described above can be suppressed by the second variable throttle 101, while the pressure oil of the second hydraulic pump 12 can be supplied to the first actuator through the first auxiliary directional control valve 24 to operate the first special attachment. That is, the pressure oil of the first hydraulic pump 11 is supplied to the bottom chamber 9*a* of the bucket cylinder 9 by priority through the bucket directional control valve 17. The pressure oil of the second hydraulic pump 12 is supplied to the bottom chamber 8*a* of the arm cylinder 8 through the second variable throttle and the first arm directional control valve 23 while the pressure oil of the second hydraulic pump 12 is also supplied to the first actuator through the first auxiliary directional control valve 24. The pressure oil of the third hydraulic pump 13 is supplied to the bottom chamber 7*a* of the boom cylinder 7 through the boom raising selection position 33*a* of the third boom directional control valve 33. Thus, the four-combined operation of boom raising, arm crowding, bucket crowding and the first special attachment can be carried out.

The first or second embodiment may have a configuration in which there is provided a first hydraulic pump swash angle control unit which makes control to increase the swash angle of the first hydraulic pump in the jack-up operation in which the bottom pressure of the boom cylinder 7 is lower than a predetermined pressure during the operation of boom raising.

In the configuration arranged thus, in the jack-up operation, control to increase the pilot pressure supplied to the control portion of the flow rate adjustment valve 11*c* belonging to the regulator of the first hydraulic pump 11 is made by the first hydraulic pump swash angle control unit so that the swash angle of the first hydraulic pump 11 can be increased. That is, the control to increase the flow rate of the first hydraulic pump 11 is performed so that the increased flow rate is supplied to the rod chamber 7*b* of the boom cylinder 7 through the first boom directional control valve 19. Thus, the jack-up operation is performed. On this occasion, for example, control to increase the flow rate of the pressure oil of the second hydraulic pump 12 is not performed. On the other hand, the pump swash angle control on the third hydraulic pump 13 is kept not executed. Thus, even when the control to increase the flow rate of the second hydraulic pump 11 is not performed and the pump swash angle control on the third hydraulic pump is kept not executed, the jack-up operation can be performed without any trouble as long as the flow rate of the first hydraulic pump 11 is increased. Accordingly, the jack-up operation can be performed while the influence on the pump efficiency is kept minimal.

The first embodiment may have a configuration in which the first torque control valve 51 serving as the first torque control unit is controlled to increase the pump torque of the first hydraulic pump 11 in accordance with a signal outputted from the controller 70 during the combined operation of the swing and the bucket. Alternatively, the second embodiment may have a configuration in which the second torque control valve 52 serving as the second torque control unit is controlled to increase the pump torque of the first hydraulic pump 11 in accordance with a signal outputted from the controller 70 during the combined operation of the swing and the bucket.

In the configuration arranged thus, for example, assume that soil or the like is dug and the dug soil is dumped through the combined operation of the swing and the bucket. In this case, when the upperstructure 2 and the bucket 6 are swung to return from a dumping site to a digging site, the first torque control valve 51 or the second torque control valve 52 are driven to increase the pump torque of the first hydraulic pump 11 so as to increase the flow rate of the pressure oil supplied from the first hydraulic pump 11 to the bottom chamber 9*a* of the bucket cylinder 9. Thus, the operating speed of the bucket cylinder 9 can be increased. That is, the operation of bucket crowding is performed at a high operating speed till the upperstructure 2 and the bucket 6 return to the digging site from the dumping site. Thus, the bucket 6 can be quickly resumed to a digging posture with a desirable biting angle of its blade edge with respect to the ground. In this manner, the digging work can be performed by the bucket 6 immediately after the upperstructure 2 and the bucket 6 return to the digging site. It is therefore possible to improve the efficiency in such digging work.

REFERENCE SIGNS LIST

2 upperstructure (body)
3 working device
4 boom
5 arm
6 bucket
7 boom cylinder
7*a* bottom chamber
7*b* rod chamber
8 arm cylinder
8*a* bottom chamber
8*b* rod chamber
9 bucket cylinder
9*a* bottom chamber
11 first hydraulic pump
12 second hydraulic pump
13 third hydraulic pump
14 pilot pump
15 tank
17 bucket directional control valve
18 second arm directional control valve
19 first boom directional control valve
20 pipe line
21 pipe line
22 second boom directional control valve
23 first arm directional control valve
24 first auxiliary directional control valve
26 pipe line
27 pipe line
28 pipe line
29 pipe line
30 auxiliary flow combiner valve
30*a* closed position
30*b* open position
31 swing motor
32 swing directional control valve
33 third boom directional control valve
33*a* boom raising selection position
33*b* boom lowering selection position
33*b*1 block port
33*b*2 regenerative circuit
34 third arm directional control valve
35 second auxiliary directional control valve
36 pipe line
37 pipe line
40 boom operating device
41 arm operating device
42 selector valve (boom directional control valve control unit)
43 open valve
43*a* left position
43*b* right position
44 electromagnetic valve
45 discharge pressure sensor (discharge pressure detection unit)
46 pipe line
47 return pipe line
58 pipe line
51 first torque control valve (first torque control unit)
52 second torque control valve (second torque control unit)
53 third torque control valve (third torque control unit)
54 first flow rate limit control valve (first flow rate limit control unit)
55 second flow rate limit control valve (second flow rate limit control unit)
56 third flow rate limit control valve (third flow rate limit control unit)
61 pressure sensor
62 electromagnetic valve
63 electromagnetic valve
64 variable throttle
70 controller
80 pipe line
81 pipe line
82 pipe line
85 pipe line
86 pipe line
87 pipe line

The invention claimed is:

1. A hydraulic drive device for a working machine, the hydraulic drive device being provided in the working machine including a body and a working device attached to the body, the working device including a boom connected to the body so as to be rotatable in an up/down direction, an arm connected to a distal end of the boom so as to be rotatable in the up/down direction, a boom cylinder driving the boom, and an arm cylinder driving the arm, the hydraulic drive device comprising:

a first hydraulic pump and a second hydraulic pump which supply pressure oil for operating the boom cylinder and the arm cylinder respectively; a first boom directional control valve and a second arm directional control valve connected in parallel to the first hydraulic pump so that the first boom directional control valve controls a flow of the pressure oil supplied to the boom cylinder and the second arm directional control valve controls a flow of the pressure oil supplied to the arm cylinder; and a second boom directional control valve and a first arm directional control valve connected in parallel to the second hydraulic pump so that the second boom directional control valve controls a flow of the pressure oil supplied to the boom cylinder and the first arm directional control valve controls a flow of the pressure oil supplied to the arm cylinder; wherein the hydraulic drive device further comprises:

a third hydraulic pump which supplies pressure oil for operating the boom cylinder and the arm cylinder; a third boom directional control valve connected to the third hydraulic pump so as to control a flow of the pressure oil supplied to the boom cylinder; and a third arm directional control valve connected in tandem with the third boom directional control valve on the downstream side of the third boom directional control valve so as to control a flow of the pressure oil supplied to the arm cylinder.

2. A hydraulic drive device for a working machine according to claim 1, wherein:

the body includes an upper structure; and the hydraulic drive device further comprises a swing motor which drives the upper structure, and a swing directional control valve which is connected to the third hydraulic pump so as to control a flow of the pressure oil supplied to the swing motor.

3. A hydraulic drive device for a working machine according to claim 2, wherein:

the swing directional control valve and the third boom directional control valve are connected in parallel.

4. A hydraulic drive device for a working machine according to claim 2, wherein:

the working device includes a bucket connected to a distal end of the arm so as to be rotatable in the up/down direction, and a bucket cylinder operating the bucket;

the hydraulic drive device further comprises a bucket directional control valve which controls a flow of the pressure oil supplied to the bucket cylinder; and the first boom directional control valve, the second arm directional control valve and the bucket directional control valve are connected in parallel.

5. A hydraulic drive device for a working machine according to claim 4, further comprising:

a second auxiliary directional control valve which is connected to the third hydraulic pump.

6. A hydraulic drive device for a working machine according to claim 5, wherein:

the swing directional control valve, the third boom directional control valve and the second auxiliary directional control valve are connected in parallel.

7. A hydraulic drive device for a working machine according to claim 6, wherein:

the second auxiliary directional control valve has an additional pump port to which an additional hydraulic pump can be connected.

8. A hydraulic drive device for a working machine according to claim 4, further comprising:

a first variable throttle which is provided on an upstream side of the second arm directional control valve.

9. A hydraulic drive device for a working machine according to claim 2, wherein:

the hydraulic drive device further comprises an engine;

the working device further includes a bucket connected to a distal end of the arm so as to be rotatable in the up/down direction, and a bucket cylinder operating the bucket;

the hydraulic drive device further comprises a bucket directional control valve which controls a flow of the pressure oil supplied to the bucket cylinder;

the first hydraulic pump, the second hydraulic pump and the third hydraulic pump consist of variable displacement hydraulic pumps which are driven by the engine, respectively;

the hydraulic drive device further comprises a first torque control unit which can variably control pump torque of the first hydraulic pump, a second torque control unit which can variably control pump torque of the second hydraulic pump, and a third torque control unit which can variably control pump torque of the third hydraulic pump; and the first torque control unit makes control to increase the pump torque of the first hydraulic pump during combined operation of the upper structure and the bucket.

10. A hydraulic drive device for a working machine according to claim 2, wherein:

the hydraulic drive device further comprises an engine;

the working device further includes a bucket connected to a distal end of the arm so as to be rotatable in the up/down direction, and a bucket cylinder operating the bucket;

the hydraulic drive device further comprises a bucket directional control valve which controls a flow of the pressure oil supplied to the bucket cylinder;

the first hydraulic pump, the second hydraulic pump and the third hydraulic pump consist of variable displacement hydraulic pumps which are driven by the engine, respectively;

the hydraulic drive device further comprises a first torque control unit which can variably control pump torque of the first hydraulic pump and pump torque of the second hydraulic pump concurrently, and a second torque control unit which can variably control pump torque of the third hydraulic pump; and the first torque control unit makes control to increase the pump torque of the first hydraulic pump and the pump torque of the second hydraulic pump during combined operation of the upper structure and the bucket.

11. A hydraulic drive device for a working machine according to claim 1, wherein:

the third boom directional control valve has a boom raising selection position which is a selection position for rotating the boom upward and a boom lowering selection position which is a selection position for rotating the boom downward, and a block port which blocks the supply of the pressure oil discharged from the third hydraulic pump to the boom cylinder is provided in the boom lowering selection position.

12. A hydraulic drive device for a working machine according to claim 11, further comprising:

a regenerative circuit which is provided in the boom lowering selection position of the third boom directional control valve so that the oil discharged from a bottom chamber of the boom cylinder can be regeneratively supplied to a rod chamber of the boom cylinder during the boom lowering operation; and a boom directional control valve control unit which holds the third boom directional control valve in the boom lowering selection position and holds the first boom directional control valve and the second boom directional control valve in neutral positions when bottom pressure of the boom cylinder is not lower than a predetermined pressure during the boom lowering operation, and which holds the third boom directional control valve in the boom lowering selection position, holds the first boom directional control valve in the boom lowering selection position where the pressure oil discharged from the first hydraulic pump can be supplied to the rod chamber of the boom cylinder, and holds the second boom directional control valve in the boom lowering selection position where the pressure oil discharged from the second hydraulic pump can be supplied to the rod chamber of the boom cylinder when the bottom pressure of the boom cylinder is lower than the predetermined pressure during the boom lowering operation.

13. A hydraulic drive device for a working machine according to claim 1, further comprising:

a first auxiliary directional control valve which is connected to the second hydraulic pump; and an auxiliary flow combiner valve by which the pressure oil discharged from the first hydraulic pump can be supplied to the first auxiliary directional control valve.

14. A hydraulic drive device for a working machine according to claim 13, wherein:

the second boom directional control valve, the first arm directional control valve and the first auxiliary directional control valve are connected in parallel.

15. A hydraulic drive device for a working machine according to claim 14, further comprising:

a second variable throttle which is provided on an upstream side of the first arm directional control valve.

16. A hydraulic drive device for a working machine according to claim 1, further comprising:

an open valve which is provided in a return pipe line connecting a tank and at least one of the first arm directional control valve, the second arm directional control valve and the third arm directional control valve, so that the open valve keeps a small opening amount when the arm is not operated, and increases the opening amount with the increase of an operation amount of the arm during arm crowding operation.

17. A hydraulic drive device for a working machine according to claim 1, further comprising:

a discharge pressure detection unit which detects at least discharge pressure of the first hydraulic pump, the discharge pressure of the second hydraulic pump and discharge pressure of the third hydraulic pump;

a directional control valve neutral holding unit which holds the third boom directional control valve and the third arm directional control valve in neutral positions when the discharge pressure detected by the discharge pressure detection unit is not lower than a predetermined pressure; and a pump control cancel unit which cancels pump swash angle control on the third hydraulic pump when the discharge pressure is not lower than the predetermined pressure.

18. A hydraulic drive device for a working machine according to claim 1, wherein:

the hydraulic drive device further comprises an engine;

of the first hydraulic pump, the second hydraulic pump and the third hydraulic pump, at least the third hydraulic pump consists of a variable displacement hydraulic pump which is driven by the engine; and the hydraulic drive device further comprises a third hydraulic pump swash angle control unit which is provided to keep pump swash angle control on the third hydraulic pump not executed when operation of the arm is an arm crowding operation.

19. A hydraulic drive device for a working machine according to claim 18, further comprising:

a first torque control unit which can variably control pump torque of the first hydraulic pump;

a second torque control unit which can variably control pump torque of the second hydraulic pump; and a third torque control unit which can variably control pump torque of the third hydraulic pump.

20. A hydraulic drive device for a working machine according to claim 18, further comprising:

a first torque control unit which can variably control pump torque of the first hydraulic pump and pump torque of the second hydraulic pump concurrently; and a second torque control unit which can variably control pump torque of the third hydraulic pump.

21. A hydraulic drive device for a working machine according to claim 1, wherein:

the hydraulic drive device further comprises an engine;

of the first hydraulic pump, the second hydraulic pump and the third hydraulic pump, at least the first hydraulic pump consists of a variable displacement hydraulic pump which is driven by the engine; and the hydraulic drive device further comprises a first hydraulic pump swash angle control unit which is provided to make control to increase a swash angle of the first hydraulic pump when bottom pressure of the boom cylinder is lower than a predetermined pressure during the boom lowering operation.

22. A hydraulic drive device for a working machine according to claim 1, further comprising:

a first flow rate limit control unit which limits a flow rate discharged from the first hydraulic pump to a predetermined rate lower than a maximum flow rate which can be discharged by the first hydraulic pump;

a second flow rate limit control unit which limits a flow rate discharged from the second hydraulic pump to a predetermined rate lower than a maximum flow rate which can be discharged by the second hydraulic pump; and a third flow rate limit control unit which limits a flow rate discharged from the third hydraulic pump to a predetermined rate lower than a maximum flow rate which can be discharged by the third hydraulic pump.

* * * * *